US010849468B2

(12) United States Patent
Ophardt et al.

(10) Patent No.: US 10,849,468 B2
(45) Date of Patent: Dec. 1, 2020

(54) FLUID DISPENSER WITH IMPROVED CATCH MECHANISM

(71) Applicant: OP-Hygiene IP GmbH, Niederbipp (CH)

(72) Inventors: Heiner Ophardt, Arisdorf (CH); Padraig McDonagh, County Sligo (IE)

(73) Assignee: OP-Hygiene IP GmbH, Niederbipp (CH)

( * ) Notice: Subject to any disclaimer, the term of this patent is extended or adjusted under 35 U.S.C. 154(b) by 0 days.

(21) Appl. No.: 16/739,907

(22) Filed: Jan. 10, 2020

(65) Prior Publication Data

US 2020/0221909 A1 Jul. 16, 2020

Related U.S. Application Data

(60) Provisional application No. 62/791,239, filed on Jan. 11, 2019.

(51) Int. Cl.
*A47K 5/12* (2006.01)

(52) U.S. Cl.
CPC ..... *A47K 5/1205* (2013.01)

(58) Field of Classification Search
CPC .. A47K 5/1205; A47K 5/1211; A47K 5/1202; B05B 11/0038; B05B 11/0054
USPC .... 222/628, 321.7, 321.8, 321.9, 372, 383.1
See application file for complete search history.

(56) References Cited

U.S. PATENT DOCUMENTS 10,098,511 B2 * 10/2018 Ophardt ..... A47K 5/1205
10,182,685 B2 * 1/2019 Ophardt ..... A47K 5/1205
10,542,850 B2 * 1/2020 Ophardt ..... A47K 5/1205
10,624,502 B2 * 4/2020 Ophardt ..... A47K 5/1205
2007/0210110 A1 * 9/2007 Anhuf ..... A47K 5/12 222/180
2009/0266842 A1 * 10/2009 Snodgrass ..... A47K 5/1217 222/52
2012/0085780 A1 * 4/2012 Landauer ..... A47K 5/12 222/52
2013/0292410 A1 * 11/2013 Pelkey ..... G01F 11/023 222/52

(Continued)

FOREIGN PATENT DOCUMENTS

CA 2985313 5/2018

*Primary Examiner* — Paul R Durand
*Assistant Examiner* — Randall A Gruby
(74) *Attorney, Agent, or Firm* — Thorpe North & Western, LLP

(57) ABSTRACT

A fluid dispenser having a piston pump mechanism and a pump driver. The pump mechanism has two piston arms, each piston arm having an inwardly extending piston tip. Each piston tip has a downwardly directed catching shoulder and an upwardly and inwardly directed camming surface. The pump driver has a first driver hook and a second driver hook, each of the driver hooks having an outwardly extending driver tip with an upwardly directed catch shoulder and a downwardly and outwardly directed cam surface. The pump driver is coupled to the pump by moving the pump driver downwards so that engagement of the cam surfaces of the driver hooks with the camming surfaces of the piston arms deflects the piston arms outwardly, until the driver tips move below the piston tips, allowing the piston arms to move inwardly to a coupled position.

20 Claims, 20 Drawing Sheets

(56) References Cited

U.S. PATENT DOCUMENTS

| | | | | |
|---|---|---|---|---|
| 2014/0253336 | A1* | 9/2014 | Ophardt | A47K 5/12 340/573.1 |
| 2015/0053720 | A1* | 2/2015 | Wolf | A47K 5/12 222/153.09 |
| 2015/0144660 | A1* | 5/2015 | Wertheim | B05B 11/0037 222/181.3 |
| 2015/0190827 | A1* | 7/2015 | Ophardt | B05B 11/0038 222/153.09 |
| 2016/0249774 | A1* | 9/2016 | Ophardt | A47K 5/1201 222/135 |
| 2020/0093335 | A1* | 3/2020 | Ophardt | A47K 5/1205 |
| 2020/0100627 | A1* | 4/2020 | Ophardt | A47K 10/32 |
| 2020/0107679 | A1* | 4/2020 | Ophardt | A47K 5/12 |
| 2020/0147626 | A1* | 5/2020 | Ophardt | B05B 11/3011 |

* cited by examiner

FLUID DISPENSER WITH IMPROVED CATCH MECHANISM

FIELD OF THE INVENTION

This invention relates to fluid dispensers, and more particularly to fluid dispensers that have a removable piston pump mechanism for dispensing hand cleaning fluid.

BACKGROUND OF THE INVENTION

Fluid dispensers for dispensing hand cleaning fluid onto a user's hand are known. Fluid dispensers typically have a fluid reservoir containing the fluid to be dispensed, and a pump mechanism for dispensing the fluid from the fluid reservoir. Often, the fluid reservoir and the pump mechanism are provided together as a disposable fluid cartridge that can be removed from the dispenser housing and replaced with a new cartridge when needed.

Various catch mechanisms for removably coupling the pump mechanism to the dispenser housing are known. For example, Canadian Patent Application Publication No. 2985313 to Ophardt et al., published May 11, 2018, discloses a fluid dispenser with a piston pump mechanism that couples to a pump actuator plate or pump driver of the housing. The pump driver has a pair of resiliently deformable arms that extend downwardly towards a piston forming element of the piston pump mechanism. When the pump driver is moved downwardly, the arms engage with the piston forming element and flex outwardly to receive the piston forming element therebetween. Once coupled, the piston pump mechanism is activated by moving the pump driver upwardly and downwardly to drive the piston forming element in a corresponding motion. To remove the pump mechanism from the housing, the piston forming element is slid forwardly from the pump driver to disengage the arms.

Some possible disadvantages of the catch mechanism disclosed in Canadian Patent Application Publication No. 2985313 include the possibility that the resiliently deformable arms on the pump driver could lose their resiliency after repeated use. There also exists the possibility that the pump driver could become laterally misaligned with the piston forming element, which could lead to improper coupling of the pump driver to the piston forming element. If misaligned, the engagement of the pump driver arms with only the outer surface of the piston forming element may not be sufficient to guide the pump driver into alignment with the piston forming element.

SUMMARY OF THE INVENTION

To at least partially overcome these disadvantages, the present invention provides a fluid dispenser with an improved alternative catch mechanism for removably coupling a piston pump mechanism to a dispenser housing. The catch mechanism of the present invention represents an improvement over the catch mechanism disclosed in Canadian Patent Application Publication No. 2985313 to Ophardt et al., published May 11, 2018, which is incorporated herein by reference.

In accordance with the invention, the piston forming element has two resilient, deformable piston arms that extend upwardly for engagement with two driver hooks that extend downwardly from the pump driver. Each piston arm has a laterally inwardly extending piston tip, with a downwardly directed catching shoulder and an upwardly and laterally inwardly directed camming surface, and each driver hook has a laterally outwardly extending driver tip with an upwardly directed catch shoulder and a downwardly and laterally outwardly directed cam surface.

The pump driver is coupled to the piston forming element by moving the pump driver downwardly so that the cam surfaces of the driver hooks engage with the camming surfaces of the piston arms, which deflects the piston arms laterally outwardly, until the driver tips move below the piston tips. The piston arms then move laterally inwardly under the resiliency of the piston arms, with the catching shoulders positioned above and in opposition to the catch shoulders.

The inventors have appreciated that the catch mechanism of the present invention has a number of advantages. For example, having resiliently deformable arms on the piston forming element rather than on the pump driver reduces the risk that the catch mechanism will fail after repeated use. This is because the piston forming element is typically replaced periodically whenever a new fluid cartridge is needed. The arms are thus unlikely to lose their resiliency before being replaced. The driver hooks, on the other hand, are not normally replaced, and need to be able to withstand repeated use over long periods of time. In accordance with the invention, the driver hooks do not need to be resiliently deformable, and can be formed from a durable, rigid material instead.

The catch mechanism of the present invention also allows for improved lateral alignment of the piston forming element with the pump driver. For example, the piston forming element optionally incorporates a central portion that is positioned between the two piston arms. When the pump driver is moved downwardly into engagement with the piston forming element, a first inner surface of the first driver hook engages with a first side surface of the central portion while the cam surface of the first driver hook engages with the camming surface of the first piston arm, and a second inner surface of the second driver hook engages with a second side surface of the central portion while the cam surface of the second driver hook engages with the camming surface of the second piston arm. There are thus four separate contact points between the pump driver and the piston forming element that help to locate the piston forming element in lateral alignment with the pump driver. The engagement of the driver hooks with the central portion of the piston forming element also helps deflect the piston arms laterally outwardly, by causing each driver hook to act as a wedge between the central portion and one of the piston arms.

The piston pump mechanism can also be removed from the housing and uncoupled from the pump driver by sliding the piston pump mechanism forwardly relative to the pump driver so that the piston arms slide forwardly past and out of engagement with the driver hooks. The piston pump mechanism can thus be replaced when needed.

Accordingly, in one aspect the present invention resides in a fluid dispenser comprising: a fluid reservoir containing a fluid to be dispensed; a housing for supporting the fluid reservoir; a piston pump mechanism for dispensing the fluid from the fluid reservoir; and a pump driver for activating the piston pump mechanism; the piston pump mechanism having a piston chamber forming body and a piston forming element; the piston forming element being coaxially slideable along an axis relative to the piston chamber forming body to draw the fluid from the fluid reservoir and discharge the fluid from a discharge outlet; the piston forming element having two resilient, deformable piston arms that extend axially upwardly from a seat portion of the piston forming element, with a first one of the piston arms positioned on a first lateral side of the piston forming element and a second one of the piston arms positioned on a second lateral side of the piston forming element; each piston arm being secured at an anchored lower end to the seat portion and extending upwardly to an upper distal end, the upper distal end of each piston arm carrying a piston hook with a laterally inwardly extending piston tip; each piston tip having an axially downwardly directed catching shoulder and an axially upwardly and laterally inwardly directed camming surface; the pump driver having a downwardly extending catch member that extends from an anchored upper end to a lower distal end, the catch member having a first driver hook and a second driver hook at the lower distal end; each of the driver hooks having a laterally outwardly extending driver tip with an axially upwardly directed catch shoulder and an axially downwardly and laterally outwardly directed cam surface; the pump driver being movably secured to the housing for axial movement relative to the housing; the piston pump mechanism being removably coupled to the housing, with the piston forming element positioned axially downwardly from the pump driver; wherein the pump driver is movable from an uncoupled position to a coupled position by: moving the pump driver axially downwards relative to the piston forming element so that the catch member engages with the piston arms, with the cam surface of the first driver hook engaging with the camming surface of the first piston arm, and the cam surface of the second driver hook engaging with the camming surface of the second piston arm, the engagement of the cam surfaces of the driver hooks with the camming surfaces of the piston arms deflecting the piston arms laterally outwardly, until the driver tips move below the piston tips, allowing the piston arms to move laterally inwardly to the coupled position under the resiliency of the piston arms; wherein, when in the coupled position, the catching shoulders of the piston arms are positioned axially above and in opposition to the catch shoulders of the driver hooks, so that movement of the pump driver axially upwards relative to the piston chamber forming body moves the piston forming element axially upwards relative to the piston chamber forming body through engagement of the catch shoulders with the catching shoulders, and movement of the pump driver axially downwards relative to the piston chamber forming body moves the piston forming element axially downwards relative to the piston chamber forming body through engagement of a contact surface of the pump driver with a contacting surface of the piston forming element; and wherein the piston arms and the driver hooks are each extended in a back-to-front direction to allow the piston arms to slide forwardly past and out of engagement with the driver hooks, the piston pump mechanism being removable from the housing by sliding the piston pump mechanism forwardly relative to the pump driver.

In preferred embodiments, each piston arm is spaced laterally from a central portion of the piston forming element that extends upwardly from the seat portion; wherein the catch member comprises a first driver arm carrying the first driver hook and a second driver arm carrying the second driver hook, the first driver arm being spaced laterally from the second driver arm so as to define a gap therebetween; and wherein the central portion of the piston forming element extends into the gap between the first driver arm and the second driver arm when the pump driver is coupled to the piston forming element.

In especially preferred embodiments, the central portion of the piston forming element has a first side surface that faces laterally outwardly towards the first piston arm, and a second side surface that faces laterally outwardly towards the second piston arm; wherein the first driver hook has a first inner surface that faces laterally inwardly towards the second driver hook; wherein the second driver hook has a second inner surface that faces laterally inwardly towards the first driver hook; and wherein, on movement of the pump driver axially downwardly from the uncoupled position to the coupled position: the first inner surface of the first driver hook engages with the first side surface of the central portion while the cam surface of the first driver hook engages with the camming surface of the first piston arm, so that the first driver hook acts as a wedge moving between the central portion of the piston forming element and the first piston arm to deflect the first piston arm laterally outwardly; and the second inner surface of the second driver hook engages with the second side surface of the central portion while the cam surface of the second driver hook engages with the camming surface of the second piston arm, so that the second driver hook acts as a wedge moving between the central portion of the piston forming element and the second piston arm to deflect the second piston arm laterally outwardly.

Optionally, the piston forming element is located in lateral alignment with the pump driver through the engagement of the first inner surface of the first driver hook with the first side surface of the central portion, the engagement of the cam surface of the first driver hook with the camming surface of the first piston arm, the engagement of the second inner surface of the second driver hook with the second side surface of the central portion, and the engagement of the cam surface of the second driver hook with the camming surface of the second piston arm.

Preferably, a first piston slot is defined between the first piston arm and the first side surface of the central portion, and a second piston slot is defined between the second piston arm and the second side surface of the central portion; wherein the first piston slot and the second piston slot are each open axially upwardly to a respective upper opening for receiving the first driver hook and the second driver hook, respectively, when the pump driver is moved axially downwardly from the uncoupled position to the coupled position; and wherein the first piston slot and the second piston slot each extend rearwardly to a respective rearward opening for releasing the first driver hook and the second driver hook, respectively, when the piston pump mechanism is slid forwardly relative to the pump driver.

The piston forming element preferably has a rear surface and a front surface; wherein the first piston slot and the second piston slot each extend forwardly from their respective rearward openings to respective terminal barriers that are spaced rearwardly from the front surface of the piston forming element; and wherein the terminal barriers prevent the first driver hook and the second driver hook from sliding forwardly of the terminal barriers when received within the first piston slot and the second piston slot, respectively.

In some preferred embodiments, the piston arms must be deflected laterally outwardly to disengage the driver hooks from the piston arms when the piston pump mechanism is slid forwardly relative to the pump driver.

Optionally, the first piston slot and the second piston slot each have a respective hook receiving area and a respective slot narrowing area, the hook receiving areas being positioned forwardly of the rearward openings, and the slot narrowing areas being positioned between the hook receiving areas and the rearward openings; wherein the first piston slot and the second piston slot each have a narrowed slot width in the slot narrowing areas, the narrowed slot width being selected so that the driver arms engage with the piston arms and deflect the piston arms laterally outwardly when the driver arms are positioned within the slot narrowing areas; and wherein the slot narrowing areas provide resistance against sliding the piston pump mechanism forwardly relative to the pump driver to disengage the driver hooks from the piston arms.

In some embodiments, the catching shoulder is directed axially downwardly and laterally inwardly and the catch shoulder is directed axially upwardly and laterally outwardly.

The contact surface may, for example, comprise a lower surface of the first driver hook and a lower surface of the second driver hook, and the contacting surface may, for example, comprise an upper surface of the seat portion of the piston forming element. The contact surface also may comprise a bottom surface of the pump driver that extends between the first driver arm and the second driver arm, and the contacting surface may comprise a top surface of the central portion of the piston forming element.

In preferred embodiments, an axial distance between the contact surface and the catch shoulders is substantially equal to an axial distance between the contacting surface and the catching shoulders.

Preferably, when the pump driver is in the coupled position, the catching shoulders of the piston arms remain in uninterrupted engagement with the catch shoulders of the driver hooks when the pump driver is moved axially upwards relative to the piston chamber forming body, and when the pump driver is moved axially downwards relative to the piston chamber forming body; and the contact surface of the pump driver remains in uninterrupted engagement with the contacting surface of the piston forming element when the pump driver is moved axially upwards relative to the piston chamber forming body, and when the pump driver is moved axially downwards relative to the piston chamber forming body.

The uninterrupted engagement of the catching shoulders with the catch shoulders and the uninterrupted engagement of the contact surface with the contacting surface when the pump driver is in the coupled position preferably causes the piston forming element to move substantially the same axial distance as the pump driver when the pump driver is moved axially while in the coupled position.

In some embodiments, the piston arms are resiliently deflectable from an unbiased inherent position to a laterally outwardly deflected position, and are biased to return to the unbiased inherent position when deflected away from the unbiased inherent position towards the deflected position; wherein, when the pump driver is in the uncoupled position and the pump driver is moved axially downwards into engagement with the piston arms, the engagement of the cam surfaces of the driver hooks with the camming surfaces of the piston arms deflects the piston arms from the unbiased inherent position towards the deflected position, and when the driver tips move below the piston tips, the piston arms move laterally inwardly to the coupled position, with the catching shoulders in engagement with the catch shoulders; and wherein the engagement of the catching shoulders with the catch shoulders while in the coupled position forces the piston arms to remain at least partially deflected laterally outwardly from the unbiased inherent position.

In other embodiments, the piston arms are resiliently deflectable from an unbiased inherent position to a laterally outwardly deflected position, and are biased to return to the unbiased inherent position when deflected away from the unbiased inherent position towards the deflected position; and wherein, when the pump driver is in the uncoupled position and the pump driver is moved axially downwards into engagement with the piston arms, the engagement of the cam surfaces of the driver hooks with the camming surfaces of the piston arms deflects the piston arms from the unbiased inherent position towards the deflected position, and when the driver tips move below the piston tips, the piston arms move laterally inwardly back to the unbiased inherent position.

The housing preferably has an engagement mechanism that engages with the piston chamber forming body and prevents the piston chamber forming body from moving axially relative to the housing when the piston pump mechanism is coupled to the housing.

The fluid dispenser preferably further comprises an actuator mechanism for moving the pump driver between a first axial position and a second axial position; wherein, when the pump driver is in the uncoupled position, activation of the actuator mechanism moves the pump driver between the first axial position and the second axial position, which causes the pump driver to move from the uncoupled position to the coupled position; and when the pump driver is in the coupled position, activation of the actuator mechanism moves the pump driver between the first axial position and the second axial position, which moves the piston forming element axially relative to the piston chamber forming body, causing the piston pump mechanism to draw the fluid from the fluid reservoir and discharge the fluid from the discharge outlet.

In some embodiments, the actuator mechanism is manually activated, and the pump driver is biased to return to the first axial position upon manual release of the actuator mechanism.

Preferably, the catch member is substantially rigid.

In another aspect, the present invention resides in a method of operating the aforementioned fluid dispenser, the method comprising: when in the uncoupled position, moving the pump driver axially downwards relative to the piston forming element so that the catch member engages with the piston arms, with the cam surface of the first driver hook engaging with the camming surface of the first piston arm, and the cam surface of the second driver hook engaging with the camming surface of the second piston arm, the engagement of the cam surfaces of the driver hooks with the camming surfaces of the piston arms deflecting the piston arms laterally outwardly, until the driver tips move below the piston tips, allowing the piston arms to move laterally inwardly to the coupled position under the resiliency of the piston arms, with the catching shoulders of the piston arms positioned axially above and in opposition to the catch shoulders of the driver hooks; and when in the coupled position, moving the pump driver axially upwards relative to the piston chamber forming body to thereby move the piston forming element axially upwards relative to the piston chamber forming body through engagement of the catch shoulders with the catching shoulders, and moving the pump driver axially downwards relative to the piston chamber forming body to thereby move the piston forming element axially downwards relative to the piston chamber forming body through engagement of a contact surface of the pump driver with a contacting surface of the piston forming element, the axial movement of the piston forming element relative to the piston chamber forming body causing the piston pump mechanism to draw the fluid from the fluid reservoir and discharge the fluid from the discharge outlet.

Optionally, the method further comprises removing the piston pump mechanism from the housing by sliding the piston pump mechanism forwardly relative to the pump driver so that the piston arms slide forwardly past and out of engagement with the driver hooks.

In a further aspect, the present invention resides in a method of operating a fluid dispenser, the fluid dispenser comprising: a fluid reservoir containing a fluid to be dispensed; a housing for supporting the fluid reservoir; a piston pump mechanism for dispensing the fluid from the fluid reservoir; and a pump driver for activating the piston pump mechanism; the piston pump mechanism having a piston chamber forming body and a piston forming element; the piston forming element being coaxially slideable along an axis relative to the piston chamber forming body to draw the fluid from the fluid reservoir and discharge the fluid from a discharge outlet; the piston forming element having two resilient, deformable piston arms that extend axially upwardly from a seat portion of the piston forming element, with a first one of the piston arms positioned on a first lateral side of the piston forming element and a second one of the piston arms positioned on a second lateral side of the piston forming element; each piston arm being secured at an anchored lower end to the seat portion and extending upwardly to an upper distal end, the upper distal end of each piston arm carrying a piston hook with a laterally inwardly extending piston tip; each piston tip having an axially downwardly directed catching shoulder and an axially upwardly and laterally inwardly directed camming surface; the pump driver having a downwardly extending catch member that extends from an anchored upper end to a lower distal end, the catch member having a first driver hook and a second driver hook at the lower distal end; each of the driver hooks having a laterally outwardly extending driver tip with an axially upwardly directed catch shoulder and an axially downwardly and laterally outwardly directed cam surface; the pump driver being movably secured to the housing for axial movement relative to the housing; the piston pump mechanism being removably coupled to the housing, with the piston forming element positioned axially downwardly from the pump driver; wherein the pump driver is movable from an uncoupled position to a coupled position; the method comprising: when in the uncoupled position, moving the pump driver axially downwards relative to the piston forming element so that the catch member engages with the piston arms, with the cam surface of the first driver hook engaging with the camming surface of the first piston arm, and the cam surface of the second driver hook engaging with the camming surface of the second piston arm, the engagement of the cam surfaces of the driver hooks with the camming surfaces of the piston arms deflecting the piston arms laterally outwardly, until the driver tips move below the piston tips, allowing the piston arms to move laterally inwardly to the coupled position under the resiliency of the piston arms, with the catching shoulders of the piston arms positioned axially above and in opposition to the catch shoulders of the driver hooks; and when in the coupled position, moving the pump driver axially upwards relative to the piston chamber forming body to thereby move the piston forming element axially upwards relative to the piston chamber forming body through engagement of the catch shoulders with the catching shoulders, and moving the pump driver axially downwards relative to the piston chamber forming body to thereby move the piston forming element axially downwards relative to the piston chamber forming body through engagement of a contact surface of the pump driver with a contacting surface of the piston forming element, the axial movement of the piston forming element relative to the piston chamber forming body causing the piston pump mechanism to draw the fluid from the fluid reservoir and discharge the fluid from the discharge outlet.

Optionally, the method further comprises removing the piston pump mechanism from the housing by sliding the piston pump mechanism forwardly relative to the pump driver so that the piston arms slide forwardly past and out of engagement with the driver hooks.

In a further aspect, the present invention resides in a fluid dispenser comprising: a fluid reservoir containing a fluid to be dispensed; a housing for supporting the fluid reservoir; a piston pump mechanism for dispensing the fluid from the fluid reservoir; and a pump driver for activating the piston pump mechanism; the piston pump mechanism having a piston chamber forming body and a piston forming element; the piston forming element being coaxially slideable along an axis relative to the piston chamber forming body to draw the fluid from the fluid reservoir and discharge the fluid from a discharge outlet; the piston forming element having two resilient, deformable piston arms that extend axially upwardly from a seat portion of the piston forming element, with a first one of the piston arms positioned on a first lateral side of the piston forming element and a second one of the piston arms positioned on a second lateral side of the piston forming element; each piston arm being secured at an anchored lower end to the seat portion and extending upwardly to an upper distal end, the upper distal end of each piston arm carrying a piston hook with a laterally inwardly extending piston tip; each piston tip having an axially downwardly directed catching shoulder and an axially upwardly and laterally inwardly directed camming surface; the pump driver having a downwardly extending catch member that extends from an anchored upper end to a lower distal end, the catch member having a first driver hook and a second driver hook at the lower distal end; each of the driver hooks having a laterally outwardly extending driver tip with an axially upwardly directed catch shoulder and an axially downwardly and laterally outwardly directed cam surface; the pump driver being movably secured to the housing for axial movement relative to the housing; the piston pump mechanism being removably coupled to the housing, with the piston forming element positioned axially downwardly from the pump driver; wherein the pump driver is movable from an uncoupled position to a coupled position by: moving the pump driver axially downwards relative to the piston forming element so that the catch member engages with the piston arms, with the cam surface of the first driver hook engaging with the camming surface of the first piston arm, and the cam surface of the second driver hook engaging with the camming surface of the second piston arm, the engagement of the cam surfaces of the driver hooks with the camming surfaces of the piston arms deflecting the piston arms laterally outwardly, until the driver tips move below the piston tips, allowing the piston arms to move laterally inwardly to the coupled position under the resiliency of the piston arms; wherein, when in the coupled position, the catching shoulders of the piston arms are positioned axially above and in opposition to the catch shoulders of the driver hooks, so that movement of the pump driver axially upwards relative to the piston chamber forming body moves the piston forming element axially upwards relative to the piston chamber forming body through engagement of the catch shoulders with the catching shoulders, and movement of the pump driver axially downwards relative to the piston chamber forming body moves the piston forming element axially downwards relative to the piston chamber forming body through engagement of a contact surface of the pump driver with a contacting surface of the piston forming element; and wherein the piston arms and the driver hooks are each extended in a back-to-front direction to allow the piston arms to slide forwardly past and out of engagement with the driver hooks, the piston pump mechanism being removable from the housing by sliding the piston pump mechanism forwardly relative to the pump driver.

Preferably, each piston arm is spaced laterally from a central portion of the piston forming element that extends upwardly from the seat portion; wherein the catch member comprises a first driver arm carrying the first driver hook and a second driver arm carrying the second driver hook, the first driver arm being spaced laterally from the second driver arm so as to define a gap therebetween; and wherein the central portion of the piston forming element extends into the gap between the first driver arm and the second driver arm when the pump driver is coupled to the piston forming element.

In some embodiments, the central portion of the piston forming element has a first side surface that faces laterally outwardly towards the first piston arm, and a second side surface that faces laterally outwardly towards the second piston arm; wherein the first driver hook has a first inner surface that faces laterally inwardly towards the second driver hook; wherein the second driver hook has a second inner surface that faces laterally inwardly towards the first driver hook; and wherein, on movement of the pump driver axially downwardly from the uncoupled position to the coupled position: the first inner surface of the first driver hook engages with the first side surface of the central portion while the cam surface of the first driver hook engages with the camming surface of the first piston arm, so that the first driver hook acts as a wedge moving between the central portion of the piston forming element and the first piston arm to deflect the first piston arm laterally outwardly; and the second inner surface of the second driver hook engages with the second side surface of the central portion while the cam surface of the second driver hook engages with the camming surface of the second piston arm, so that the second driver hook acts as a wedge moving between the central portion of the piston forming element and the second piston arm to deflect the second piston arm laterally outwardly.

Preferably, the piston forming element is located in lateral alignment with the pump driver through the engagement of the first inner surface of the first driver hook with the first side surface of the central portion, the engagement of the cam surface of the first driver hook with the camming surface of the first piston arm, the engagement of the second inner surface of the second driver hook with the second side surface of the central portion, and the engagement of the cam surface of the second driver hook with the camming surface of the second piston arm.

Optionally, a first piston slot is defined between the first piston arm and the first side surface of the central portion, and a second piston slot is defined between the second piston arm and the second side surface of the central portion; wherein the first piston slot and the second piston slot are each open axially upwardly to a respective upper opening for receiving the first driver hook and the second driver hook, respectively, when the pump driver is moved axially downwardly from the uncoupled position to the coupled position; and wherein the first piston slot and the second piston slot each extend rearwardly to a respective rearward opening for releasing the first driver hook and the second driver hook, respectively, when the piston pump mechanism is slid forwardly relative to the pump driver.

In some preferred embodiments, the piston forming element has a rear surface and a front surface; wherein the first piston slot and the second piston slot each extend forwardly from their respective rearward openings to respective terminal barriers that are spaced rearwardly from the front surface of the piston forming element; and wherein the terminal barriers prevent the first driver hook and the second driver hook from sliding forwardly of the terminal barriers when received within the first piston slot and the second piston slot, respectively.

In some embodiments, the piston arms must be deflected laterally outwardly to disengage the driver hooks from the piston arms when the piston pump mechanism is slid forwardly relative to the pump driver; wherein the first piston slot and the second piston slot each have a respective hook receiving area and a respective slot narrowing area, the hook receiving areas being positioned forwardly of the rearward openings, and the slot narrowing areas being positioned between the hook receiving areas and the rearward openings; wherein the first piston slot and the second piston slot each have a narrowed slot width in the slot narrowing areas, the narrowed slot width being selected so that the driver arms engage with the piston arms and deflect the piston arms laterally outwardly when the driver arms are positioned within the slot narrowing areas; and wherein the slot narrowing areas provide resistance against sliding the piston pump mechanism forwardly relative to the pump driver to disengage the driver hooks from the piston arms.

Optionally, the catching shoulders are directed axially downwardly and laterally inwardly and the catch shoulders are directed axially upwardly and laterally outwardly.

The contact surface may, for example, comprise a lower surface of the first driver hook and a lower surface of the second driver hook, and the contacting surface may, for example, comprise an upper surface of the seat portion of the piston forming element.

In some embodiments, the contact surface comprises a bottom surface of the pump driver that extends between the first driver arm and the second driver arm, and the contacting surface comprises a top surface of the central portion of the piston forming element.

Preferably, an axial distance between the contact surface and the catch shoulders is substantially equal to an axial distance between the contacting surface and the catching shoulders; wherein, when the pump driver is in the coupled position, the catching shoulders of the piston arms remain in uninterrupted engagement with the catch shoulders of the driver hooks when the pump driver is moved axially upwards relative to the piston chamber forming body, and when the pump driver is moved axially downwards relative to the piston chamber forming body; wherein, when the pump driver is in the coupled position, the contact surface of the pump driver remains in uninterrupted engagement with the contacting surface of the piston forming element when the pump driver is moved axially upwards relative to the piston chamber forming body, and when the pump driver is moved axially downwards relative to the piston chamber forming body; and wherein the uninterrupted engagement of the catching shoulders with the catch shoulders and the uninterrupted engagement of the contact surface with the contacting surface when the pump driver is in the coupled position causes the piston forming element to move substantially the same axial distance as the pump driver when the pump driver is moved axially while in the coupled position.

In some embodiments, the piston arms are resiliently deflectable from an unbiased inherent position to a laterally outwardly deflected position, and are biased to return to the unbiased inherent position when deflected away from the unbiased inherent position towards the deflected position;

wherein, when the pump driver is in the uncoupled position and the pump driver is moved axially downwards into engagement with the piston arms, the engagement of the cam surfaces of the driver hooks with the camming surfaces of the piston arms deflects the piston arms from the unbiased inherent position towards the deflected position, and when the driver tips move below the piston tips, the piston arms move laterally inwardly to the coupled position, with the catching shoulders in engagement with the catch shoulders; and wherein the engagement of the catching shoulders with the catch shoulders while in the coupled position forces the piston arms to remain at least partially deflected laterally outwardly from the unbiased inherent position.

In other embodiments, the piston arms are resiliently deflectable from an unbiased inherent position to a laterally outwardly deflected position, and are biased to return to the unbiased inherent position when deflected away from the unbiased inherent position towards the deflected position; and wherein, when the pump driver is in the uncoupled position and the pump driver is moved axially downwards into engagement with the piston arms, the engagement of the cam surfaces of the driver hooks with the camming surfaces of the piston arms deflects the piston arms from the unbiased inherent position towards the deflected position, and when the driver tips move below the piston tips, the piston arms move laterally inwardly back to the unbiased inherent position.

Preferably, the housing has an engagement mechanism that engages with the piston chamber forming body and prevents the piston chamber forming body from moving axially relative to the housing when the piston pump mechanism is coupled to the housing.

The fluid dispenser may, for example, further comprise an actuator mechanism for moving the pump driver between a first axial position and a second axial position; wherein, when the pump driver is in the uncoupled position, activation of the actuator mechanism moves the pump driver between the first axial position and the second axial position, which causes the pump driver to move from the uncoupled position to the coupled position; and when the pump driver is in the coupled position, activation of the actuator mechanism moves the pump driver between the first axial position and the second axial position, which moves the piston forming element axially relative to the piston chamber forming body, causing the piston pump mechanism to draw the fluid from the fluid reservoir and discharge the fluid from the discharge outlet; wherein the actuator mechanism is manually activated, and the pump driver is biased to return to the first axial position upon manual release of the actuator mechanism; and wherein the catch member is substantially rigid.

In some embodiments, a first piston slot is defined between the first piston arm and the first side surface of the central portion, and a second piston slot is defined between the second piston arm and the second side surface of the central portion; wherein the first piston slot and the second piston slot are each open axially upwardly to a respective upper opening for receiving the first driver hook and the second driver hook, respectively, when the pump driver is moved axially downwardly from the uncoupled position to the coupled position; wherein the first piston slot and the second piston slot each extend rearwardly to a respective rearward opening for releasing the first driver hook and the second driver hook, respectively, when the piston pump mechanism is slid forwardly relative to the pump driver; wherein the piston forming element has a rear surface and a front surface; wherein the first piston slot and the second piston slot each extend forwardly from their respective rearward openings to respective terminal barriers that are spaced rearwardly from the front surface of the piston forming element; wherein the terminal barriers prevent the first driver hook and the second driver hook from sliding forwardly of the terminal barriers when received within the first piston slot and the second piston slot, respectively; wherein the piston arms must be deflected laterally outwardly to disengage the driver hooks from the piston arms when the piston pump mechanism is slid forwardly relative to the pump driver; wherein the first piston slot and the second piston slot each have a respective hook receiving area and a respective slot narrowing area, the hook receiving areas being positioned forwardly of the rearward openings, and the slot narrowing areas being positioned between the hook receiving areas and the rearward openings; wherein the first piston slot and the second piston slot each have a narrowed slot width in the slot narrowing areas, the narrowed slot width being selected so that the driver arms engage with the piston arms and deflect the piston arms laterally outwardly when the driver arms are positioned within the slot narrowing areas; and wherein the slot narrowing areas provide resistance against sliding the piston pump mechanism forwardly relative to the pump driver to disengage the driver hooks from the piston arms.

Optionally, the catching shoulders are directed axially downwardly and laterally inwardly and the catch shoulders are directed axially upwardly and laterally outwardly; wherein an axial distance between the contact surface and the catch shoulders is substantially equal to an axial distance between the contacting surface and the catching shoulders; wherein, when the pump driver is in the coupled position, the catching shoulders of the piston arms remain in uninterrupted engagement with the catch shoulders of the driver hooks when the pump driver is moved axially upwards relative to the piston chamber forming body, and when the pump driver is moved axially downwards relative to the piston chamber forming body; wherein, when the pump driver is in the coupled position, the contact surface of the pump driver remains in uninterrupted engagement with the contacting surface of the piston forming element when the pump driver is moved axially upwards relative to the piston chamber forming body, and when the pump driver is moved axially downwards relative to the piston chamber forming body; and wherein the uninterrupted engagement of the catching shoulders with the catch shoulders and the uninterrupted engagement of the contact surface with the contacting surface when the pump driver is in the coupled position causes the piston forming element to move substantially the same axial distance as the pump driver when the pump driver is moved axially while in the coupled position.

In some preferred embodiments, the housing has an engagement mechanism that engages with the piston chamber forming body and prevents the piston chamber forming body from moving axially relative to the housing when the piston pump mechanism is coupled to the housing; the fluid dispenser further comprising an actuator mechanism for moving the pump driver between a first axial position and a second axial position; wherein, when the pump driver is in the uncoupled position, activation of the actuator mechanism moves the pump driver between the first axial position and the second axial position, which causes the pump driver to move from the uncoupled position to the coupled position; and when the pump driver is in the coupled position, activation of the actuator mechanism moves the pump driver between the first axial position and the second axial position, which moves the piston forming element axially relative to the piston chamber forming body, causing the piston pump mechanism to draw the fluid from the fluid reservoir and discharge the fluid from the discharge outlet; wherein the actuator mechanism is manually activated, and the pump driver is biased to return to the first axial position upon manual release of the actuator mechanism; and wherein the catch member is substantially rigid.

In some embodiments, the contact surface comprises a lower surface of the first driver hook and a lower surface of the second driver hook, and the contacting surface comprises an upper surface of the seat portion of the piston forming element; wherein the piston arms are resiliently deflectable from an unbiased inherent position to a laterally outwardly deflected position, and are biased to return to the unbiased inherent position when deflected away from the unbiased inherent position towards the deflected position; wherein, when the pump driver is in the uncoupled position and the pump driver is moved axially downwards into engagement with the piston arms, the engagement of the cam surfaces of the driver hooks with the camming surfaces of the piston arms deflects the piston arms from the unbiased inherent position towards the deflected position, and when the driver tips move below the piston tips, the piston arms move laterally inwardly to the coupled position, with the catching shoulders in engagement with the catch shoulders; and wherein the engagement of the catching shoulders with the catch shoulders while in the coupled position forces the piston arms to remain at least partially deflected laterally outwardly from the unbiased inherent position.

In other embodiments, the contact surface comprises a bottom surface of the pump driver that extends between the first driver arm and the second driver arm, and the contacting surface comprises a top surface of the central portion of the piston forming element; wherein the piston arms are resiliently deflectable from an unbiased inherent position to a laterally outwardly deflected position, and are biased to return to the unbiased inherent position when deflected away from the unbiased inherent position towards the deflected position; and wherein, when the pump driver is in the uncoupled position and the pump driver is moved axially downwards into engagement with the piston arms, the engagement of the cam surfaces of the driver hooks with the camming surfaces of the piston arms deflects the piston arms from the unbiased inherent position towards the deflected position, and when the driver tips move below the piston tips, the piston arms move laterally inwardly back to the unbiased inherent position.

In another aspect, the present invention resides in a method of operating the aforementioned fluid dispenser, the method comprising: when in the uncoupled position, moving the pump driver axially downwards relative to the piston forming element so that the catch member engages with the piston arms, with the cam surface of the first driver hook engaging with the camming surface of the first piston arm, and the cam surface of the second driver hook engaging with the camming surface of the second piston arm, the engagement of the cam surfaces of the driver hooks with the camming surfaces of the piston arms deflecting the piston arms laterally outwardly, until the driver tips move below the piston tips, allowing the piston arms to move laterally inwardly to the coupled position under the resiliency of the piston arms, with the catching shoulders of the piston arms positioned axially above and in opposition to the catch shoulders of the driver hooks; and when in the coupled position, moving the pump driver axially upwards relative to the piston chamber forming body to thereby move the piston forming element axially upwards relative to the piston chamber forming body through engagement of the catch shoulders with the catching shoulders, and moving the pump driver axially downwards relative to the piston chamber forming body to thereby move the piston forming element axially downwards relative to the piston chamber forming body through engagement of a contact surface of the pump driver with a contacting surface of the piston forming element, the axial movement of the piston forming element relative to the piston chamber forming body causing the piston pump mechanism to draw the fluid from the fluid reservoir and discharge the fluid from the discharge outlet.

Optionally, the method further comprises removing the piston pump mechanism from the housing by sliding the piston pump mechanism forwardly relative to the pump driver so that the piston arms slide forwardly past and out of engagement with the driver hooks.

In a further aspect, the present invention resides in a fluid dispenser comprising: a fluid reservoir containing a fluid to be dispensed; a housing for supporting the fluid reservoir; a piston pump mechanism for dispensing the fluid from the fluid reservoir; and a pump driver for activating the piston pump mechanism; the piston pump mechanism having a piston chamber forming body and a piston forming element; the piston forming element being coaxially slideable along an axis relative to the piston chamber forming body to draw the fluid from the fluid reservoir and discharge the fluid from a discharge outlet; the piston forming element having two resilient, deformable piston arms that extend axially upwardly from a seat portion of the piston forming element, with a first one of the piston arms positioned on a first lateral side of the piston forming element and a second one of the piston arms positioned on a second lateral side of the piston forming element; each piston arm being secured at an anchored lower end to the seat portion and extending upwardly to an upper distal end, the upper distal end of each piston arm carrying a piston hook with a laterally inwardly extending piston tip; each piston tip having an axially downwardly directed catching shoulder and an axially upwardly and laterally inwardly directed camming surface; the pump driver having a downwardly extending catch member that extends from an anchored upper end to a lower distal end, the catch member having a first driver hook and a second driver hook at the lower distal end; each of the driver hooks having a laterally outwardly extending driver tip with an axially upwardly directed catch shoulder and an axially downwardly and laterally outwardly directed cam surface; the pump driver being movably secured to the housing for axial movement relative to the housing; the piston pump mechanism being removably coupled to the housing, with the piston forming element positioned axially downwardly from the pump driver; wherein the pump driver is movable from an uncoupled position to a coupled position by: moving the pump driver axially downwards relative to the piston forming element so that the catch member engages with the piston arms, with the cam surface of the first driver hook engaging with the camming surface of the first piston arm, and the cam surface of the second driver hook engaging with the camming surface of the second piston arm, the engagement of the cam surfaces of the driver hooks with the camming surfaces of the piston arms deflecting the piston arms laterally outwardly, until the driver tips move below the piston tips, allowing the piston arms to move laterally inwardly to the coupled position under the resiliency of the piston arms; wherein, when in the coupled position, the catching shoulders of the piston arms are positioned axially above and in opposition to the catch shoulders of the driver hooks, so that movement of the pump driver axially upwards relative to the piston chamber forming body moves the piston forming element axially upwards relative to the piston chamber forming body through engagement of the catch shoulders with the catching shoulders, and movement of the pump driver axially downwards relative to the piston chamber forming body moves the piston forming element axially downwards relative to the piston chamber forming body through engagement of a contact surface of the pump driver with a contacting surface of the piston forming element; and wherein the piston arms and the driver hooks are each extended in a back-to-front direction to allow the piston arms to slide forwardly past and out of engagement with the driver hooks, the piston pump mechanism being removable from the housing by sliding the piston pump mechanism forwardly relative to the pump driver.

In some embodiments, each piston arm is spaced laterally from a central portion of the piston forming element that extends upwardly from the seat portion; wherein the catch member comprises a first driver arm carrying the first driver hook and a second driver arm carrying the second driver hook, the first driver arm being spaced laterally from the second driver arm so as to define a gap therebetween; and wherein the central portion of the piston forming element extends into the gap between the first driver arm and the second driver arm when the pump driver is coupled to the piston forming element.

Optionally, the central portion of the piston forming element has a first side surface that faces laterally outwardly towards the first piston arm, and a second side surface that faces laterally outwardly towards the second piston arm; wherein the first driver hook has a first inner surface that faces laterally inwardly towards the second driver hook; wherein the second driver hook has a second inner surface that faces laterally inwardly towards the first driver hook; and wherein, on movement of the pump driver axially downwardly from the uncoupled position to the coupled position: the first inner surface of the first driver hook engages with the first side surface of the central portion while the cam surface of the first driver hook engages with the camming surface of the first piston arm, so that the first driver hook acts as a wedge moving between the central portion of the piston forming element and the first piston arm to deflect the first piston arm laterally outwardly; and the second inner surface of the second driver hook engages with the second side surface of the central portion while the cam surface of the second driver hook engages with the camming surface of the second piston arm, so that the second driver hook acts as a wedge moving between the central portion of the piston forming element and the second piston arm to deflect the second piston arm laterally outwardly.

In some embodiments, the piston forming element is located in lateral alignment with the pump driver through the engagement of the first inner surface of the first driver hook with the first side surface of the central portion, the engagement of the cam surface of the first driver hook with the camming surface of the first piston arm, the engagement of the second inner surface of the second driver hook with the second side surface of the central portion, and the engagement of the cam surface of the second driver hook with the camming surface of the second piston arm.

Optionally, a first piston slot is defined between the first piston arm and the first side surface of the central portion, and a second piston slot is defined between the second piston arm and the second side surface of the central portion; wherein the first piston slot and the second piston slot are each open axially upwardly to a respective upper opening for receiving the first driver hook and the second driver hook, respectively, when the pump driver is moved axially downwardly from the uncoupled position to the coupled position; and wherein the first piston slot and the second piston slot each extend rearwardly to a respective rearward opening for releasing the first driver hook and the second driver hook, respectively, when the piston pump mechanism is slid forwardly relative to the pump driver.

In some preferred embodiments, the piston forming element has a rear surface and a front surface; wherein the first piston slot and the second piston slot each extend forwardly from their respective rearward openings to respective terminal barriers that are spaced rearwardly from the front surface of the piston forming element; and wherein the terminal barriers prevent the first driver hook and the second driver hook from sliding forwardly of the terminal barriers when received within the first piston slot and the second piston slot, respectively.

In some embodiments, the piston arms must be deflected laterally outwardly to disengage the driver hooks from the piston arms when the piston pump mechanism is slid forwardly relative to the pump driver; wherein the first piston slot and the second piston slot each have a respective hook receiving area and a respective slot narrowing area, the hook receiving areas being positioned forwardly of the rearward openings, and the slot narrowing areas being positioned between the hook receiving areas and the rearward openings; wherein the first piston slot and the second piston slot each have a narrowed slot width in the slot narrowing areas, the narrowed slot width being selected so that the driver arms engage with the piston arms and deflect the piston arms laterally outwardly when the driver arms are positioned within the slot narrowing areas; and wherein the slot narrowing areas provide resistance against sliding the piston pump mechanism forwardly relative to the pump driver to disengage the driver hooks from the piston arms.

Optionally, the catching shoulders are directed axially downwardly and laterally inwardly and the catch shoulders are directed axially upwardly and laterally outwardly.

The contact surface may, for example, comprise a lower surface of the first driver hook and a lower surface of the second driver hook, and the contacting surface may, for example, comprise an upper surface of the seat portion of the piston forming element.

In some embodiments, the contact surface comprises a bottom surface of the pump driver that extends between the first driver arm and the second driver arm, and the contacting surface comprises a top surface of the central portion of the piston forming element.

Preferably, an axial distance between the contact surface and the catch shoulders is substantially equal to an axial distance between the contacting surface and the catching shoulders; wherein, when the pump driver is in the coupled position, the catching shoulders of the piston arms remain in uninterrupted engagement with the catch shoulders of the driver hooks when the pump driver is moved axially upwards relative to the piston chamber forming body, and when the pump driver is moved axially downwards relative to the piston chamber forming body; wherein, when the pump driver is in the coupled position, the contact surface of the pump driver remains in uninterrupted engagement with the contacting surface of the piston forming element when the pump driver is moved axially upwards relative to the piston chamber forming body, and when the pump driver is moved axially downwards relative to the piston chamber forming body; and wherein the uninterrupted engagement of the catching shoulders with the catch shoulders and the uninterrupted engagement of the contact surface with the contacting surface when the pump driver is in the coupled position causes the piston forming element to move substantially the same axial distance as the pump driver when the pump driver is moved axially while in the coupled position.

In some embodiments, the piston arms are resiliently deflectable from an unbiased inherent position to a laterally outwardly deflected position, and are biased to return to the unbiased inherent position when deflected away from the unbiased inherent position towards the deflected position; wherein, when the pump driver is in the uncoupled position and the pump driver is moved axially downwards into engagement with the piston arms, the engagement of the cam surfaces of the driver hooks with the camming surfaces of the piston arms deflects the piston arms from the unbiased inherent position towards the deflected position, and when the driver tips move below the piston tips, the piston arms move laterally inwardly to the coupled position, with the catching shoulders in engagement with the catch shoulders; and wherein the engagement of the catching shoulders with the catch shoulders while in the coupled position forces the piston arms to remain at least partially deflected laterally outwardly from the unbiased inherent position.

In other embodiments, the piston arms are resiliently deflectable from an unbiased inherent position to a laterally outwardly deflected position, and are biased to return to the unbiased inherent position when deflected away from the unbiased inherent position towards the deflected position; and wherein, when the pump driver is in the uncoupled position and the pump driver is moved axially downwards into engagement with the piston arms, the engagement of the cam surfaces of the driver hooks with the camming surfaces of the piston arms deflects the piston arms from the unbiased inherent position towards the deflected position, and when the driver tips move below the piston tips, the piston arms move laterally inwardly back to the unbiased inherent position.

Preferably, the housing has an engagement mechanism that engages with the piston chamber forming body and prevents the piston chamber forming body from moving axially relative to the housing when the piston pump mechanism is coupled to the housing.

In some embodiments, the fluid dispenser further comprises an actuator mechanism for moving the pump driver between a first axial position and a second axial position; wherein, when the pump driver is in the uncoupled position, activation of the actuator mechanism moves the pump driver between the first axial position and the second axial position, which causes the pump driver to move from the uncoupled position to the coupled position; and when the pump driver is in the coupled position, activation of the actuator mechanism moves the pump driver between the first axial position and the second axial position, which moves the piston forming element axially relative to the piston chamber forming body, causing the piston pump mechanism to draw the fluid from the fluid reservoir and discharge the fluid from the discharge outlet; wherein the actuator mechanism is manually activated, and the pump driver is biased to return to the first axial position upon manual release of the actuator mechanism; and wherein the catch member is substantially rigid.

In another aspect, the present invention resides in a method of operating the aforementioned fluid dispenser, the method comprising: when in the uncoupled position, moving the pump driver axially downwards relative to the piston forming element so that the catch member engages with the piston arms, with the cam surface of the first driver hook engaging with the camming surface of the first piston arm, and the cam surface of the second driver hook engaging with the camming surface of the second piston arm, the engagement of the cam surfaces of the driver hooks with the camming surfaces of the piston arms deflecting the piston arms laterally outwardly, until the driver tips move below the piston tips, allowing the piston arms to move laterally inwardly to the coupled position under the resiliency of the piston arms, with the catching shoulders of the piston arms positioned axially above and in opposition to the catch shoulders of the driver hooks; and when in the coupled position, moving the pump driver axially upwards relative to the piston chamber forming body to thereby move the piston forming element axially upwards relative to the piston chamber forming body through engagement of the catch shoulders with the catching shoulders, and moving the pump driver axially downwards relative to the piston chamber forming body to thereby move the piston forming element axially downwards relative to the piston chamber forming body through engagement of a contact surface of the pump driver with a contacting surface of the piston forming element, the axial movement of the piston forming element relative to the piston chamber forming body causing the piston pump mechanism to draw the fluid from the fluid reservoir and discharge the fluid from the discharge outlet.

Optionally, the method further comprises removing the piston pump mechanism from the housing by sliding the piston pump mechanism forwardly relative to the pump driver so that the piston arms slide forwardly past and out of engagement with the driver hooks.

BRIEF DESCRIPTION OF THE DRAWINGS

Further aspects and advantages of the invention will appear from the following description taken together with the accompanying drawings, in which.

DETAILED DESCRIPTION OF THE DRAWINGS

Figure 1:
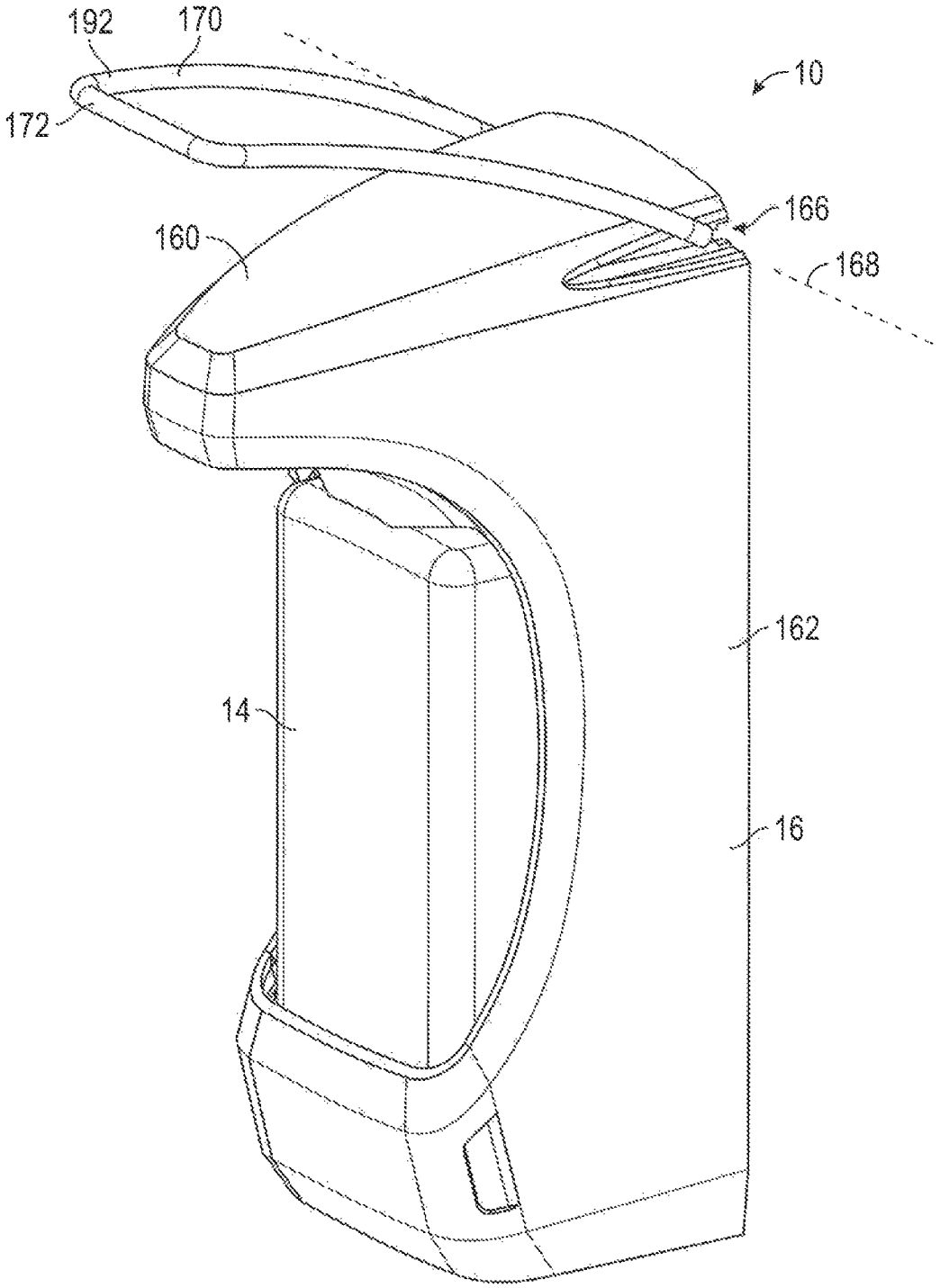
FIG. 1 is a perspective view of a fluid dispenser in accordance with a first embodiment of the present invention.
Figure 2:
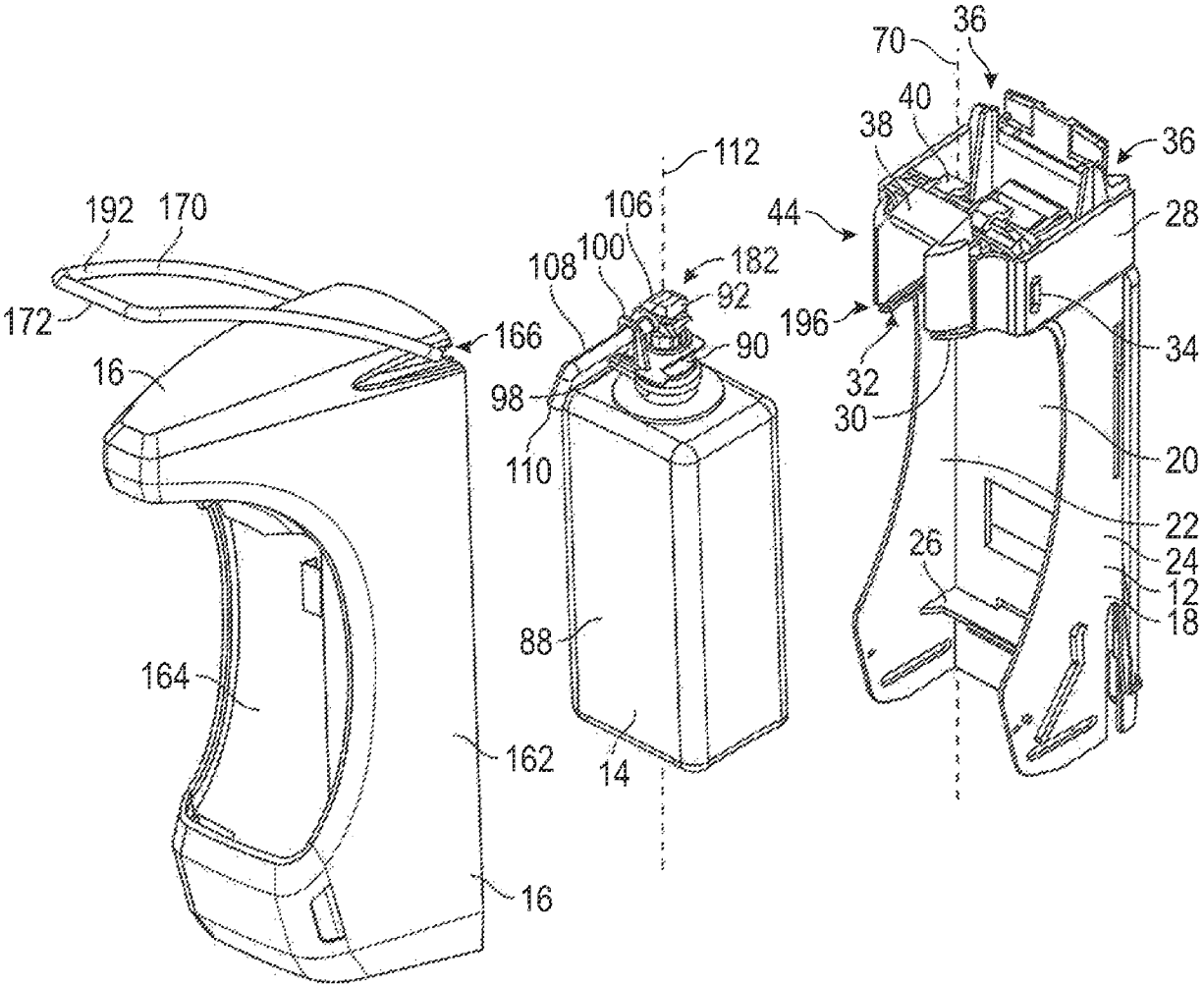
FIG. 2 is a partially exploded perspective view of the fluid dispenser shown in FIG. 1, including a replaceable cartridge, a housing, and a housing cover.

FIGS. 1 and 2 show a fluid dispenser 10 in accordance with a first embodiment of the invention. The fluid dispenser 10 has a housing 12, a replaceable cartridge 14, and a housing cover 16. The fluid dispenser 10 is substantially identical to the dispenser disclosed in Canadian Patent Application Publication No. 2985313 to Ophardt et al., published May 11, 2018, except for the catch mechanism 198 that is used to removably couple the replaceable cartridge 14 to the housing 12.

As shown in FIG. 2, the housing 12 has a housing body 18 including a back panel 20, a left side panel 22, a right side panel 24, a bottle support flange 26, and a pump receiving portion 28. The back panel 20 is configured to be mounted to a vertical support surface such as a wall or a post. The left side panel 22 and the right side panel 24 extend forwardly from the left and right sides of the back panel 20, respectively. The bottle support flange 26 extends horizontally across the back panel 20 between the left side panel 22 and the right side panel 24 near the bottom of the housing body 18.

Figure 3:
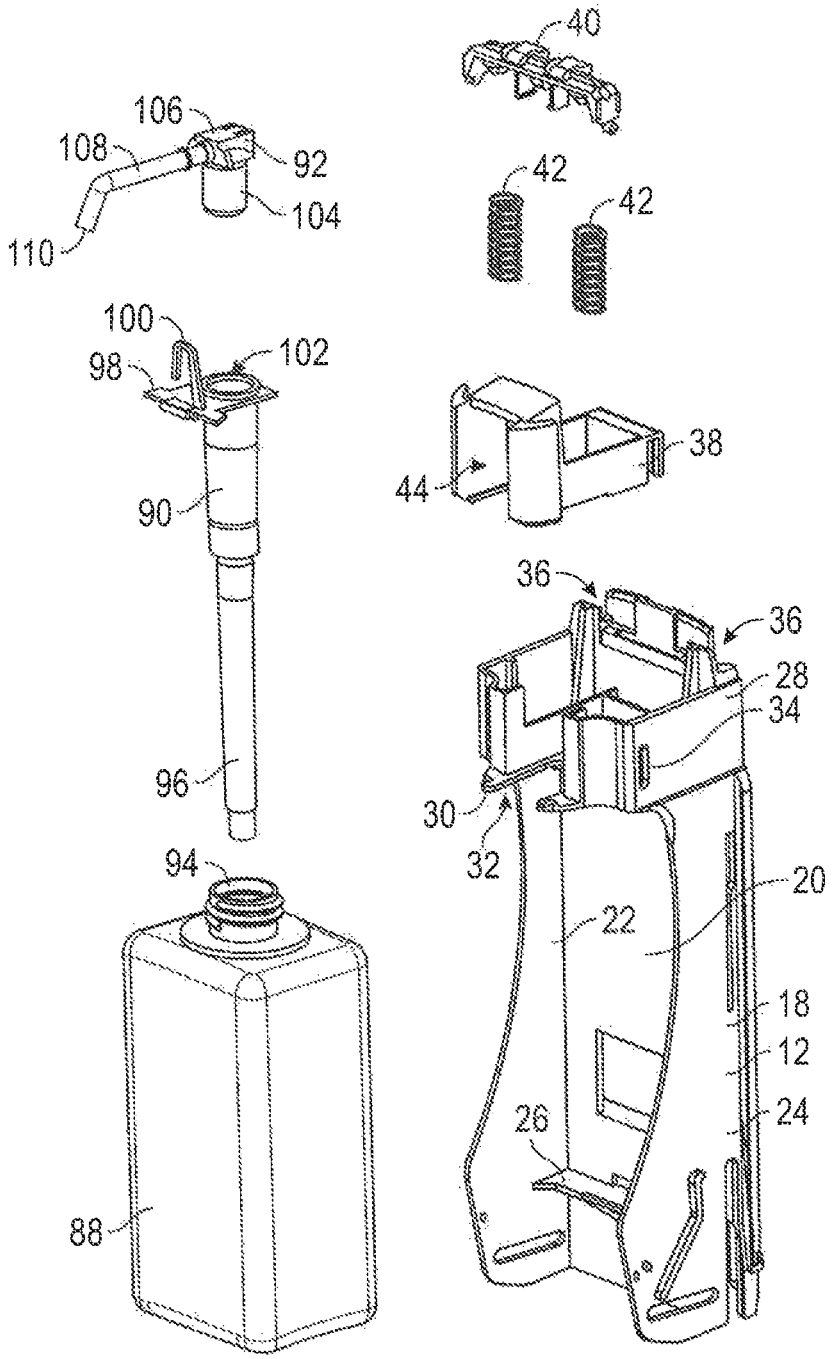
FIG. 3 is a partially exploded perspective view of the replaceable cartridge and the housing shown in FIG. 2, including a piston forming element and a pump driver.

The pump receiving portion 28 is positioned at the top of the housing body 18. As best shown in FIG. 3, the pump receiving portion 28 has a horizontal support flange 30 with an upwardly directed support surface and a pump receiving slot 32 that is open at the front of the flange 30. The pump receiving portion 28 also has two vertically oriented driver slots 34 which extend through the left side panel 22 and the right side panel 24, respectively, although only one of the driver slots 34 is visible in FIG. 3. Two actuator pivot seats 36 are positioned at the top of the left side panel 22 and the right side panel 24, respectively, near the top of the back panel 20.

The housing 12 also includes an upper pump holding member 38, a pump driver 40, and two biasing springs 42, as shown in exploded view in FIG. 3. The upper pump holding member 38 sits above the support flange 30 and has a forwardly open pump accepting slot 44 that is positioned above the pump receiving slot 32.

Figure 9:
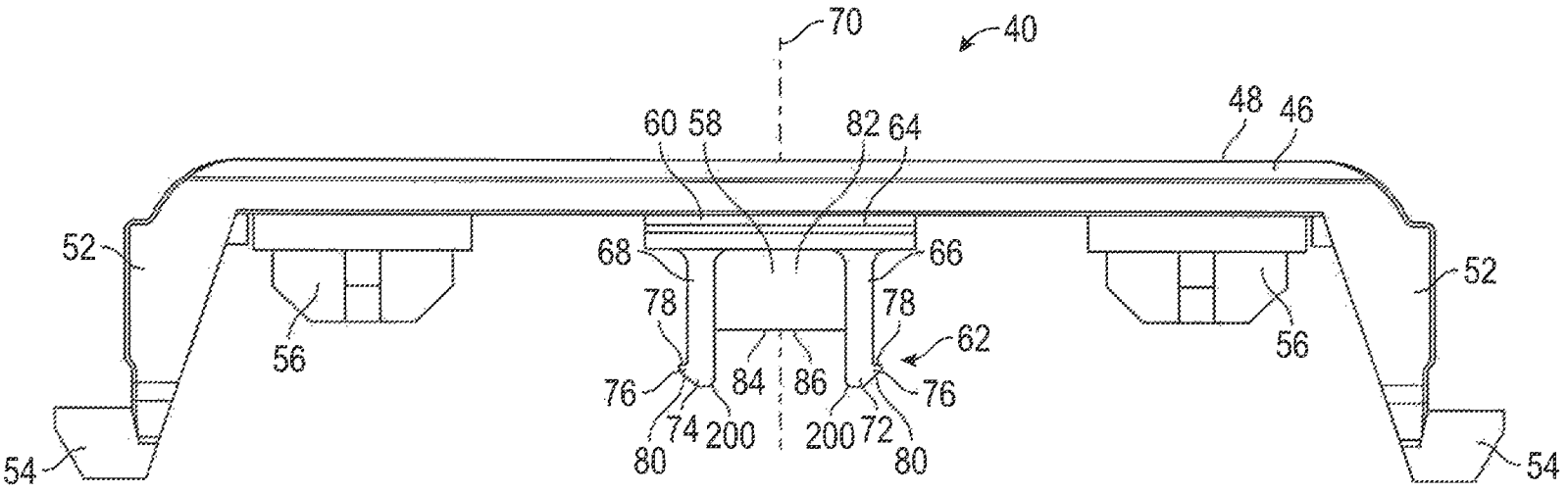
FIG. 9 is a front view of the pump driver shown in FIG. 3.
Figure 10:
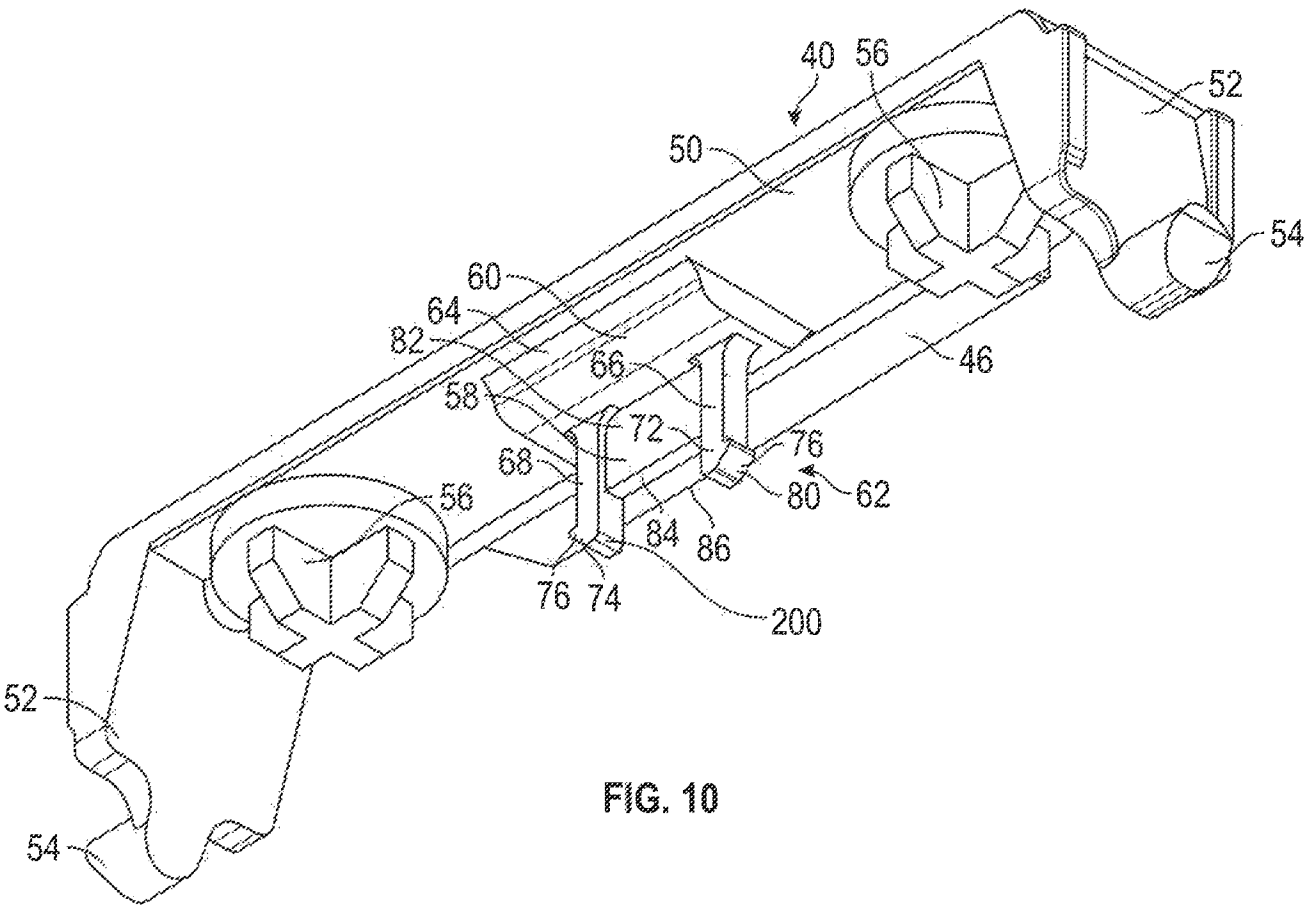
FIG. 10 is a perspective view of the pump driver shown in FIG. 9.

The pump driver 40 is shown in FIGS. 9 and 10 as having a top plate 46 with an upper surface 48 and a lower surface 50, and two side tabs 52 that extend downwardly from the left and right sides of the top plate 46, respectively. Each of the side tabs 52 has a driver pin 54 that extends laterally outwardly therefrom and is received in a respective one of the driver slots 43 in the housing body 18, so as to permit the pump driver 40 to slide upwardly and downwardly relative to the housing body 18 along a vertical driver axis 70. A catch member 58 extends downwardly from the center of the lower surface 50 of the top plate 46. Preferably, the catch member 58 is substantially rigid.

The catch member 58 extends from an anchored upper end 60 to a lower distal end 62. The catch member 58 has a support pedestal 64 at the anchored upper end 60. Two laterally spaced driver arms 66, 68 extend downwardly from the support pedestal 64 on the left and right sides of the driver axis 70, respectively. The first driver arm 66 has a first driver hook 72 at the lower distal end 62, and the second driver arm 68 has a second driver hook 74 at the lower distal end 62. Each of the first and second driver hooks 72, 74 have a laterally outwardly extending driver tip 76 with an axially upwardly directed catch shoulder 78 and an axially downwardly and laterally outwardly directed cam surface 80. The first driver hook 72 has a first inner surface 138 that faces laterally inwardly towards the second driver hook 74, and the second driver hook 74 has a second inner surface 140 that faces laterally inwardly towards the first driver hook 72. The first inner surface 138 and the second inner surface 140 each have a beveled bottom edge 200 that faces laterally inwardly and axially downwardly.

For clarity, the term "driver hook" 72, 74 as used above refers to the portion of the driver arm 66, 68 at the lower distal end 62 of the catch member 58, including the driver tip 76, and the term "driver tip" 76 refers to the portion of the driver hook 72, 74 that extends laterally outwardly from the driver arm 66, 68.

A bridge member 82 having a flat bottom surface 84 extends between the first driver arm 66 and the second driver arm 68. The bottom surface 84 is positioned axially upwardly from the driver hooks 72, 74, so as to provide a gap 86 between the driver hooks 72, 74 at the lower distal end 62 of the catch member 58. Two spring receiving bodies 56 extend downwardly from the lower surface 50 of the top plate 46 on either side of the catch member 58. The biasing springs 42 extend between the spring receiving bodies 56 and a lower surface of the pump receiving portion 28 of the housing body 18, biasing the pump driver 40 axially upwardly relative to the housing body 18.

As shown in FIG. 3, the replaceable cartridge 14 includes a fluid reservoir 88, a piston chamber-forming body 90, and a piston-forming element 92. The fluid reservoir 88 contains a hand cleaning fluid to be dispensed from the fluid dispenser 10, and has an upwardly open reservoir outlet 94. The piston chamber-forming body 90 and the piston-forming element 92 together form a piston pump mechanism 182 for dispensing the fluid from the fluid reservoir 88. The piston chamber-forming body 90 has a dip tube 96 at its lower end that extends into the reservoir outlet 94 for drawing the hand cleaning fluid from the reservoir 88, and a support plate 98 at its upper end. A retaining hook 100 extends upwardly from the support plate 98. The piston chamber-forming body 90 has an internal central cavity 102 for slideably receiving the piston-forming element 92 therein.

The piston-forming element 92 has a lower portion 104 that is slideably received within the central cavity 102 of the piston chamber-forming body 90, and an upper portion 106 that remains outside of the central cavity 102. A discharge tube 108 extends forwardly from the upper portion 106 and has a discharge outlet 110 for discharging the hand cleaning fluid onto a user's hands. The piston-forming element 92 is coaxially slideable along a pump axis 112 relative to the piston chamber-forming body 90 to draw the fluid from the fluid reservoir 88 and discharge the fluid from the discharge outlet 110.

Figure 7:
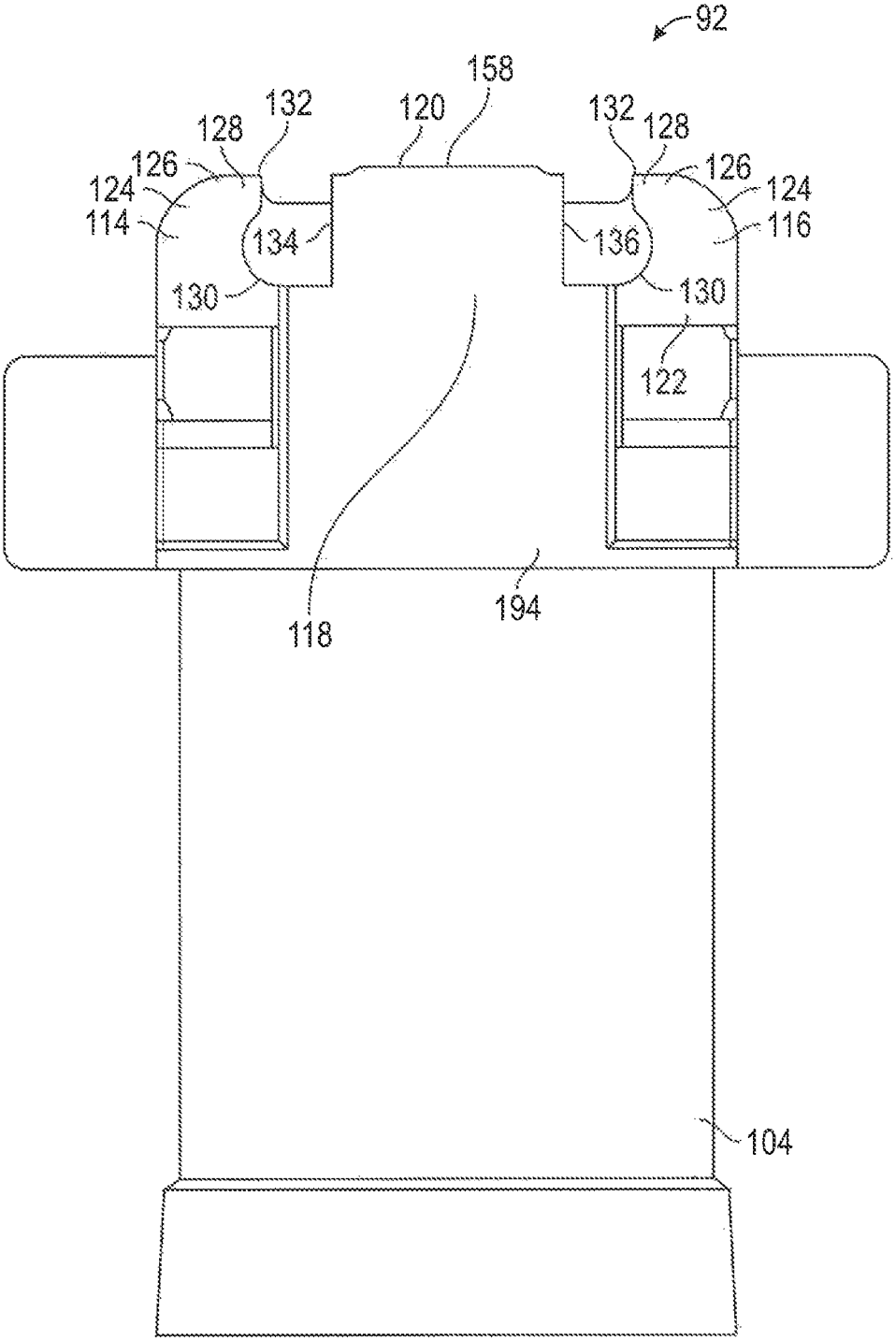
FIG. 7 is a rear view of the piston forming element shown in FIG. 5.

The upper portion 106 of the piston-forming element 92 is best shown in FIGS. 5 to 8 as having a front surface 152, a rear surface 194, and two resilient, deformable piston arms 114, 116 that extend upwardly from a seat portion 118 of the piston-forming element 92. The first piston arm 114 is positioned on the right side of the piston-forming element 92 and the second piston arm 116 is positioned on the left side of the piston-forming element 92, with a central portion 120 of the piston-forming element 92 positioned therebetween. As best shown in FIG. 7, each piston arm 114, 116 is secured to the seat portion 118 at an anchored lower end 122 and extends upwardly to an upper distal end 124. The upper distal end 124 of each piston arm 114, 116 has a piston hook 126 with a laterally inwardly extending piston tip 128. Each piston tip 128 has an axially downwardly directed catching shoulder 130 and an axially upwardly and laterally inwardly directed camming surface 132. As shown in FIG. 7, the camming surface 132 comprises the top inner edge of the piston tip 128.

For clarity, the term "piston hook" 126 as used above refers to the portion of the piston arm 114, 116 at the upper distal end 124 of the piston arm 114, 116, including the piston tip 128, and the term "piston tip" 128 refers to the portion of the piston hook 114, 116 that extends laterally inwardly from the piston arm 114, 116.

The central portion 120 of the piston-forming element 92 extends upwardly from the seat portion 118 to a top surface 158, and has a first side surface 134 that faces laterally outwardly towards the first piston arm 114, and a second side surface 136 that faces laterally outwardly towards the second piston arm 116. A first piston slot 142 is defined between the first piston arm 114 and the first side surface 134 of the central portion 120, and a second piston slot 144 is defined between the second piston arm 116 and the second side surface 136 of the central portion 120. The first piston slot 142 and the second piston slot 144 are each open axially upwardly to a respective upper opening 146, and extend rearwardly to a respective rearward opening 148. The first piston slot 142 and the second piston slot 144 each extend forwardly from their respective rearward openings 148 to respective blind forward ends or terminal barriers 150 that are spaced rearwardly from the front surface 152 of the piston-forming element 92.

Figure 8:
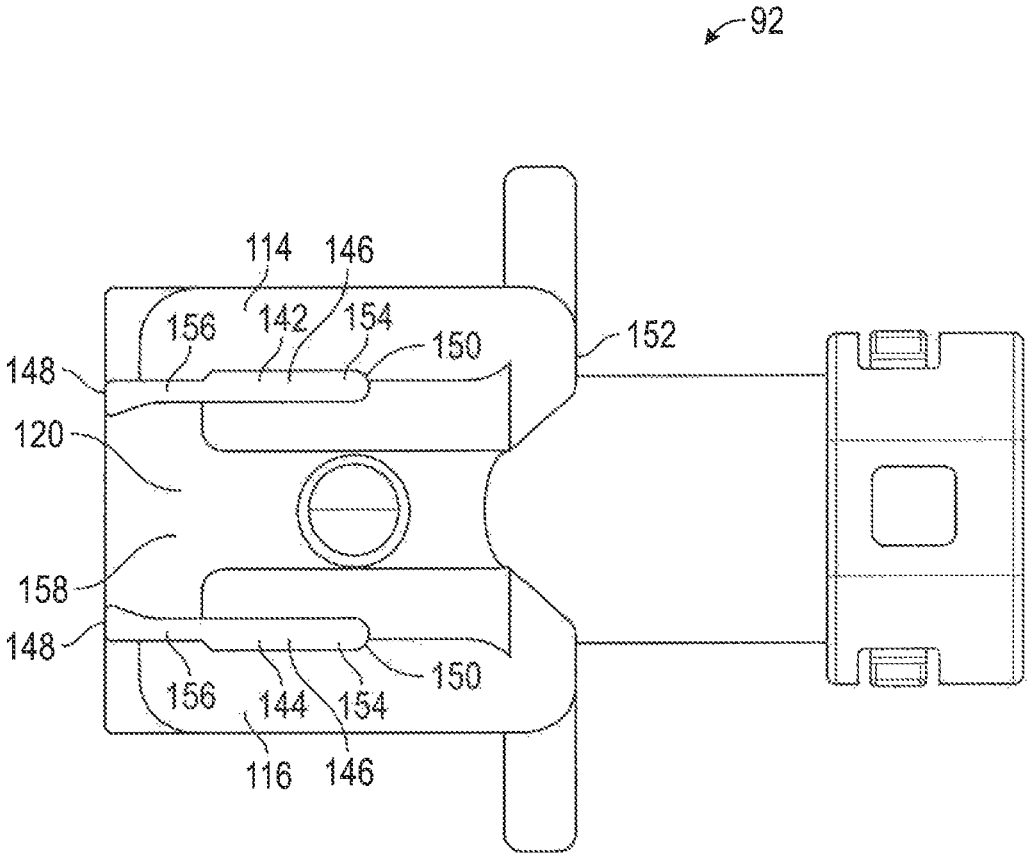
FIG. 8 is a top view of the piston forming element shown in FIG. 5.

As seen in top view in FIG. 8, the first piston slot 142 and the second piston slot 144 each have a hook receiving area 154 and a slot narrowing area 156. The hook receiving areas 154 are positioned adjacent to the terminal barriers 150, and the slot narrowing areas 156 are positioned between the hook receiving areas 154 and the rearward openings 148. The first piston slot 142 and the second piston slot 144 each have a slot width in the lateral direction that is smaller in the slot narrowing areas 156 than in the hook receiving areas 154. The slot width is narrower in the slot narrowing areas 156 because the piston tips 128 extend further inwardly towards the central portion 120 in the slot narrowing areas than in the hook receiving areas 154.

Figure 4:
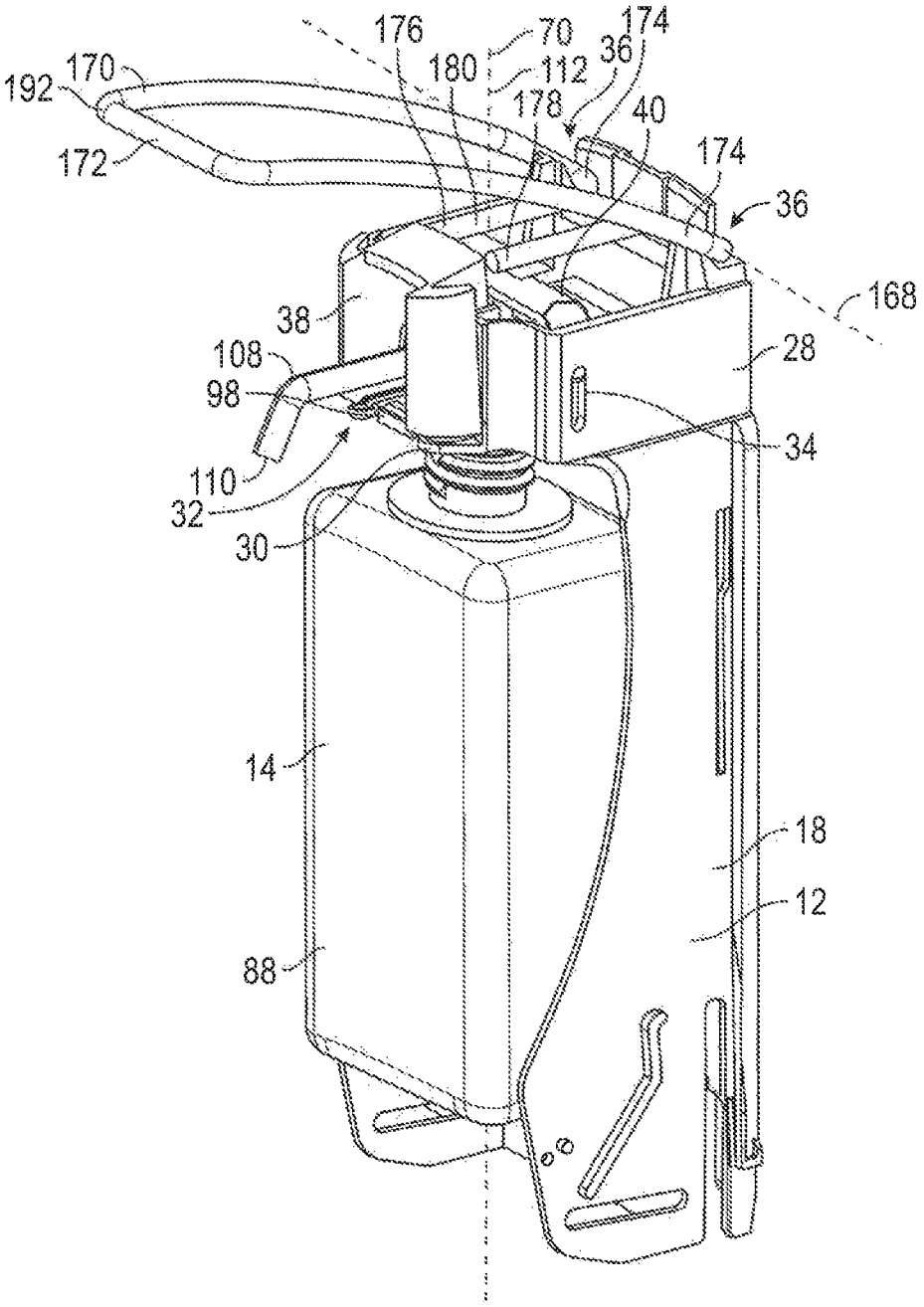
FIG. 4 is a perspective view of the fluid dispenser shown in FIG. 1, with the housing cover removed.
Figure 5:
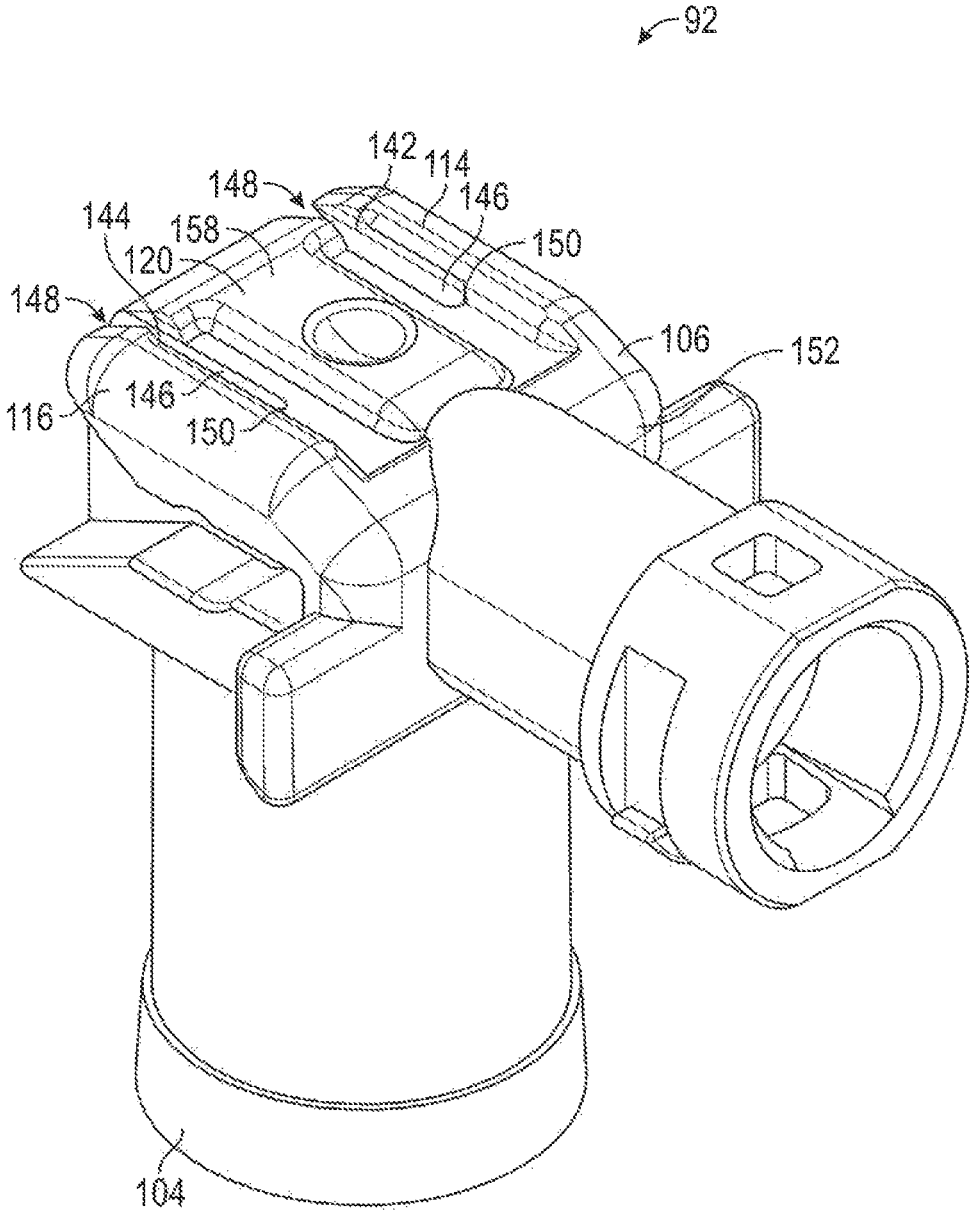
FIG. 5 is a perspective view of the piston forming element shown in FIG. 3, with the discharge tube omitted.
Figure 6:
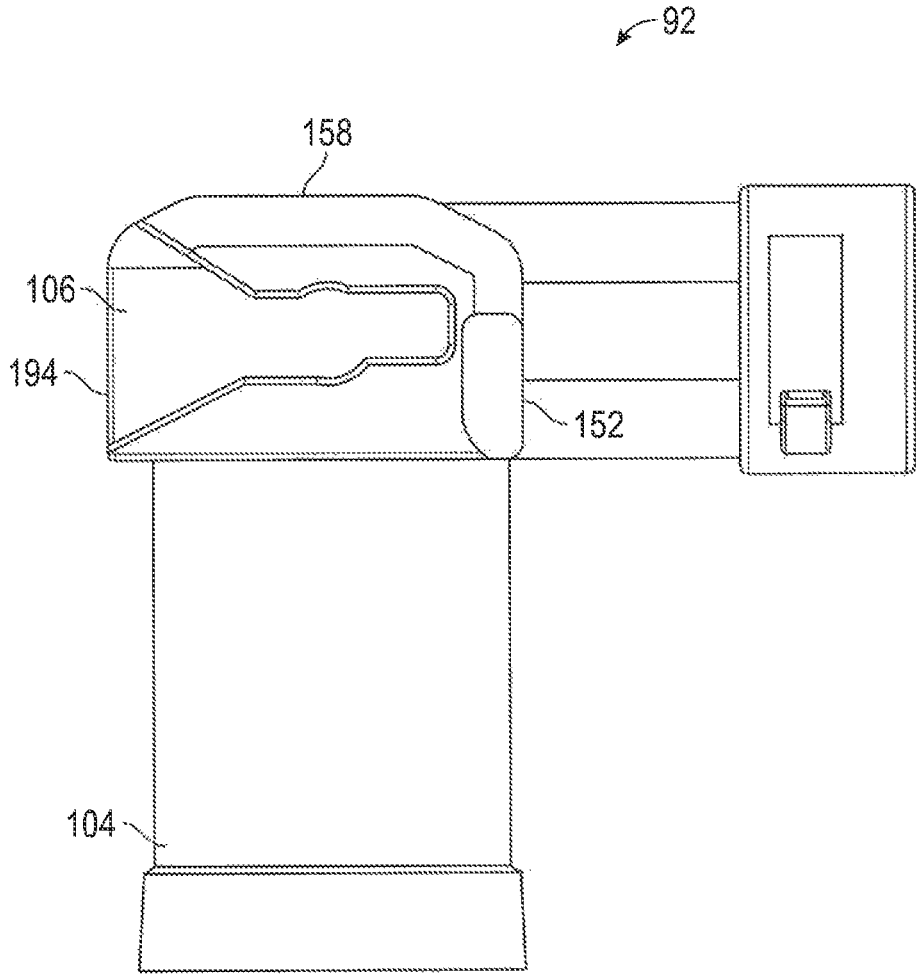
FIG. 6 is a side view of the piston forming element shown in FIG. 5.

The housing cover 18 is removably secured to the housing 12, and includes a top wall 160, a right cover side wall 162, and a left cover side wall 164, as shown in FIG. 2. An axle keyway opening 166 extends laterally through each of the side walls 162, 164 along an actuator axis 168. A lever 170 is pivotally received by the axle keyway openings 166 for pivoting about the actuator axis 168. As best shown in FIG. 4, the lever 170 includes an exterior handle portion 172, an axle 174, and an interior actuator portion 176. The axle 174 is received within the axle keyway openings 166. The interior actuator portion 176 includes a right activator rod 178 and a left activator rod 180 which extend forwardly from the axle 174 and engage with the upper surface 48 of the pump driver 40. The lever 170 serves as an actuator mechanism 192 for moving the pump driver 40 along the driver axis 70, as described below.

The operation of the fluid dispenser 10 will now be described with reference to FIGS. 1 to 16. To assemble the dispenser 10, the replaceable cartridge 14 is mounted to the housing 12 by sliding the upper portion 106 of the piston-forming element 92 into the pump receiving slot 32, with the support plate 98 of the piston chamber-forming body 90 positioned between the horizontal support flange 30 and the bottom surface of the upper pump holding member 38, until rearward sliding is stopped by engagement between a rearwardly directed surface of the support plate 98 and a forwardly directed surface of the housing 12 locating the piston-forming element 92 in an uncoupled position relative the pump driver 40. The horizontal support flange 30 and the upper pump holding member 38 serve as a pump engagement mechanism 196 that engages with the support plate 98 of the piston chamber-forming body 90 and prevents the piston chamber-forming body 90 from moving axially relative to the housing 12 when the piston pump mechanism 182 is coupled to the housing 12. The fluid reservoir 88 is supported by the bottle support flange 26. When the replaceable cartridge 14 is mounted to the housing 12, the piston-forming element 92 is positioned below the pump driver 40, and the pump axis 112 is substantially aligned with the driver axis 70. The housing cover 16 is then mounted onto the housing 12, with the lever 170 pivotally mounted to the axle keyway openings 116 and the actuator pivot seats 36.

Figure 11:
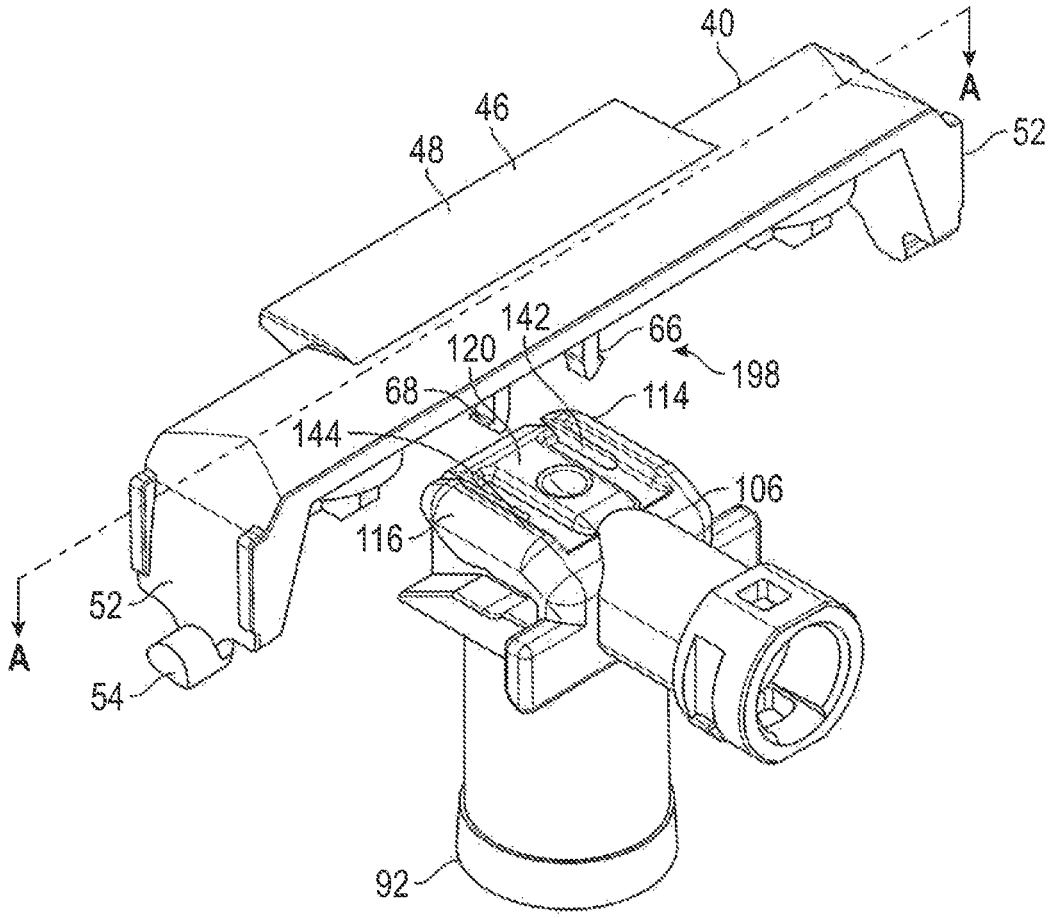
FIG. 11 is a perspective view of the piston forming element shown in FIG. 5 and the pump driver shown in FIG. 9 in an uncoupled position.
Figure 12:
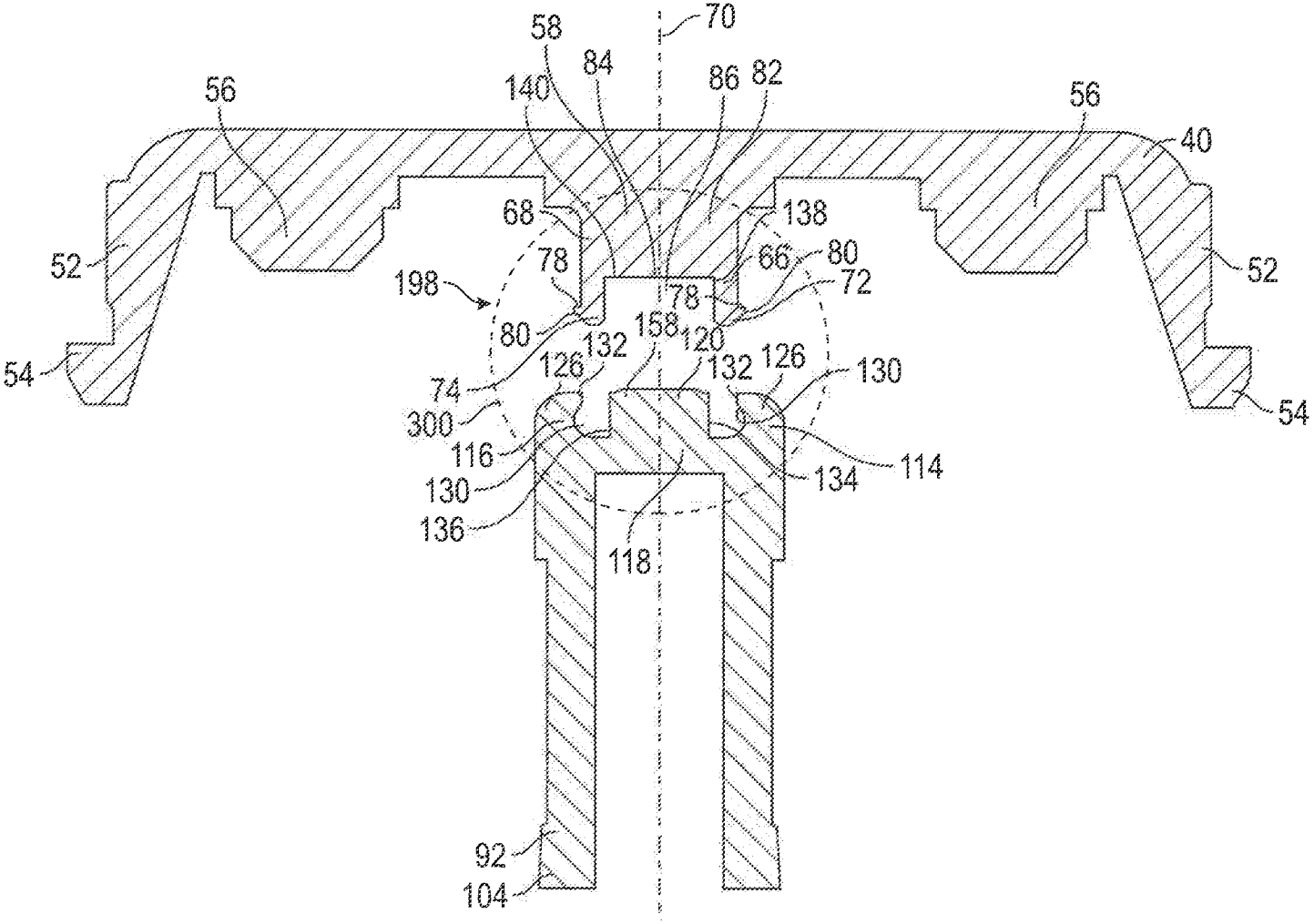
FIG. 12 is a cross-sectional view of the piston forming element and the pump driver in the uncoupled position shown in FIG. 11, taken along section line A-A' in FIG. 11.
Figure 12A:
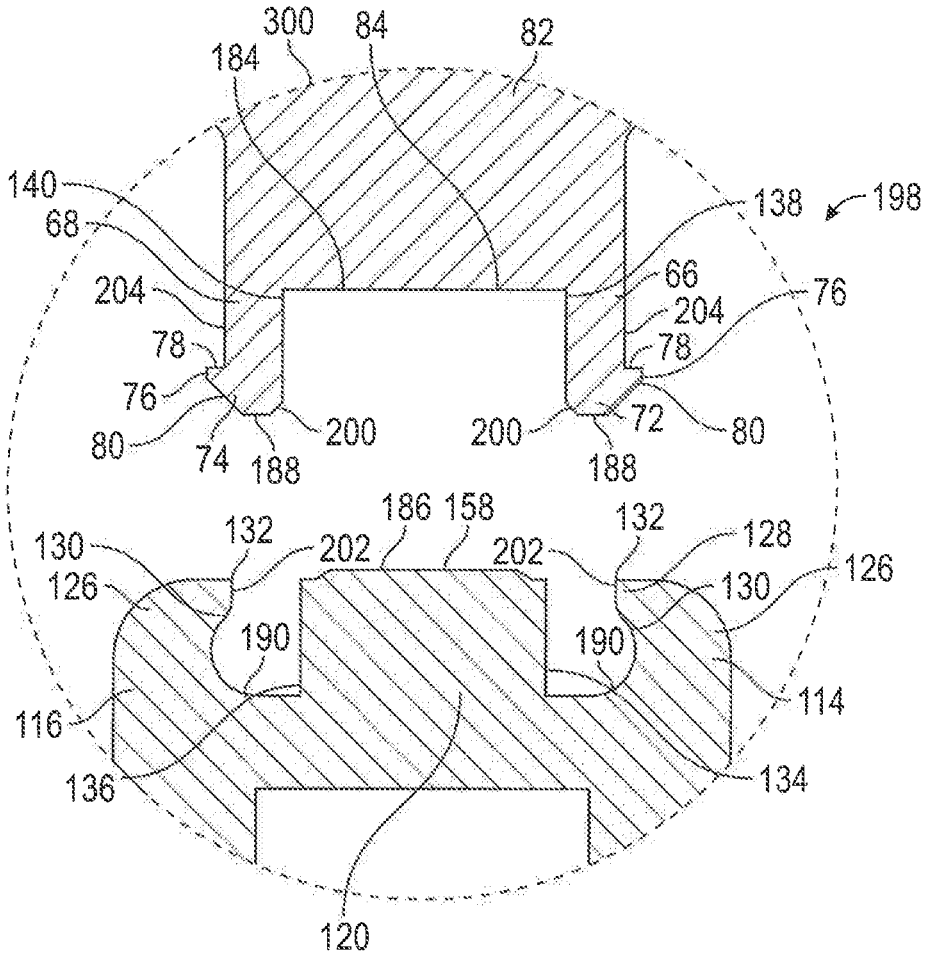
FIG. 12A is an enlarged view of area 300 of the cross-sectional view shown in FIG. 12.
Figure 13:
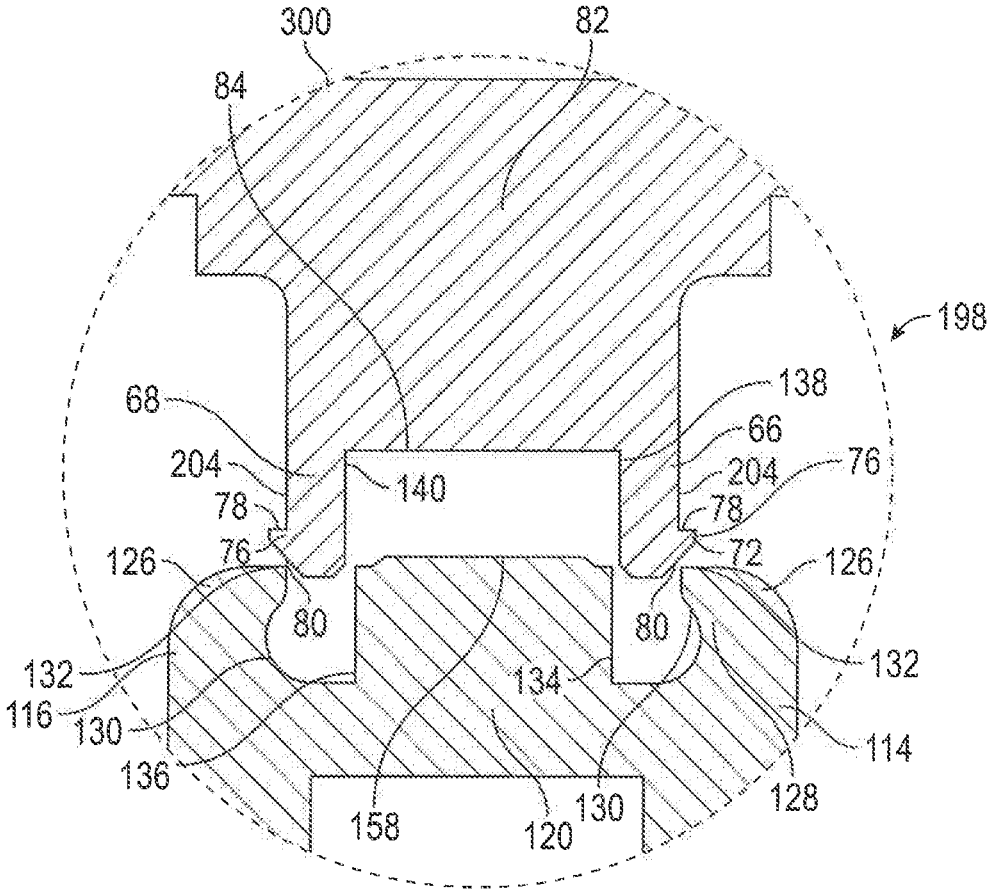
FIG. 13 is an enlarged cross-sectional view of the piston forming element and the pump driver shown in FIG. 12A in a first intermediate position.

When the replaceable cartridge 14 is initially mounted to the housing 12, the pump driver 40 is in the uncoupled position relative to the piston-forming element 92, with the catch member 58 spaced axially above the upper portion 106 of the piston-forming element 92 at a first axial position, as shown in FIGS. 11, 12 and 12A. The upper portion 106 of the piston forming element 92 and the catch member 58 together serve as a catch mechanism 198 for coupling the piston driver 40 to the piston-forming element 92. The pump driver 40 is coupled to the piston-forming element 92 by pulling the exterior handle portion 172 of the lever 170 downwardly, for example with a user's hand. This pivots the lever 170 about the actuator axis 168, causing the interior actuator portion 176 of the lever 170 to pivot downwardly into engagement with the upper surface 48 of the pump driver 40, which drives the pump driver 40 downwardly towards the piston-forming element 92 along the driver axis 70 from the first axial position, as shown in FIG. 12, to a second axial position, as shown in FIG. 15. This moves the pump driver 40 from the uncoupled position, as shown in FIGS. 11, 12 and 12A, to a first intermediate position, as shown in FIG. 13, and then to a second intermediate position, as shown in FIG. 14, and finally to a coupled position, as shown in FIG. 15.

When the replaceable cartridge 14 is initially mounted to the housing 12, with the pump driver 40 in the uncoupled position relative to the piston-forming element 92 and the catch member 58 spaced axially above the upper portion 106 of the piston-forming element 92 in the first axial position as shown in FIG. 12, the piston-forming element 92 is located forwardly to rearwardly relative the pump driver 40 so that the first driver hook 72 and the second driver hook 74 are above the hook receiving area 154 of each of the first piston arm 114 and the second piston arm 116. As the pump driver 40 moves downwardly towards the piston-forming element 92 to the first intermediate position as shown in FIG. 13, the cam surface 80 of the first driver hook 72 engages in the hook receiving area 154 with the camming surface 132 of the first piston arm 114, and the cam surface 80 of the second driver hook 74 engages in the hook receiving area 154 with the camming surface 132 of the second piston arm 116. As the pump driver 40 moves further downwards to the second intermediate position as shown in FIG. 14, the engagement of the cam surfaces 80 with the camming surfaces 132 deflects the piston arms 114, 116 laterally outwardly from their unbiased inherent position, as shown in FIG. 12A, towards a laterally outwardly deflected position, as shown in FIG. 14.

Figure 14:
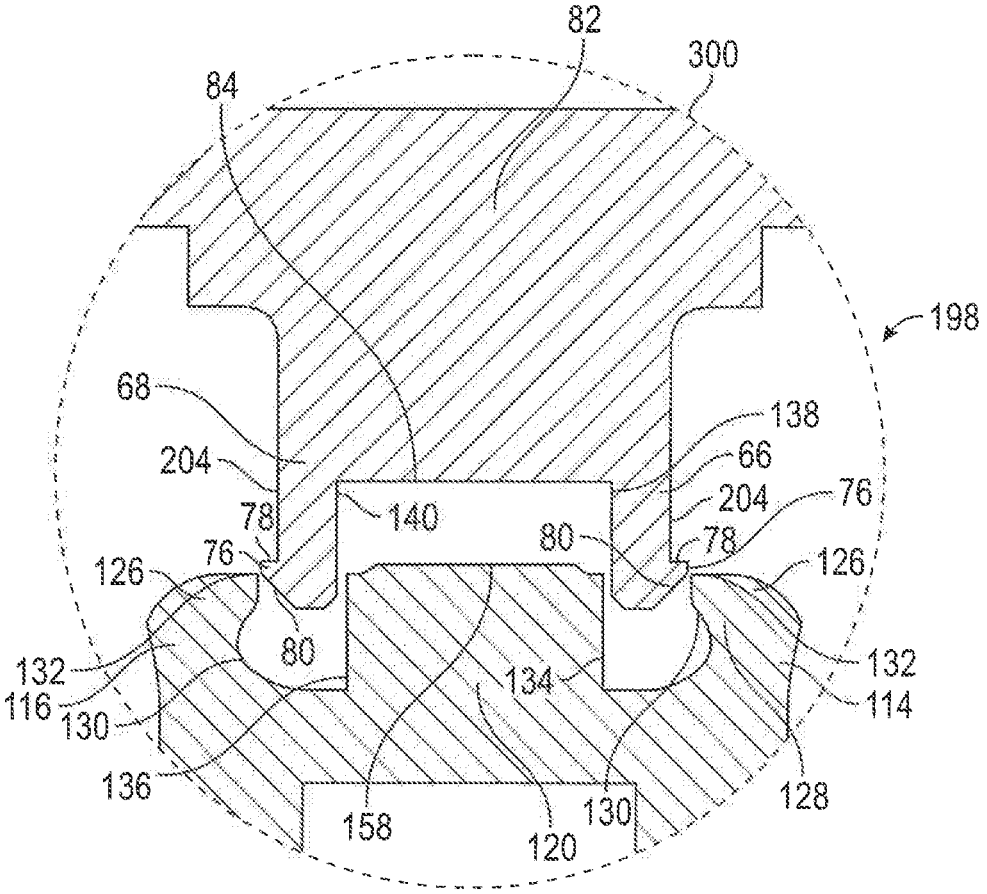
FIG. 14 is an enlarged cross-sectional view of the piston forming element and the pump driver shown in FIG. 12A in a second intermediate position.
Figure 15:
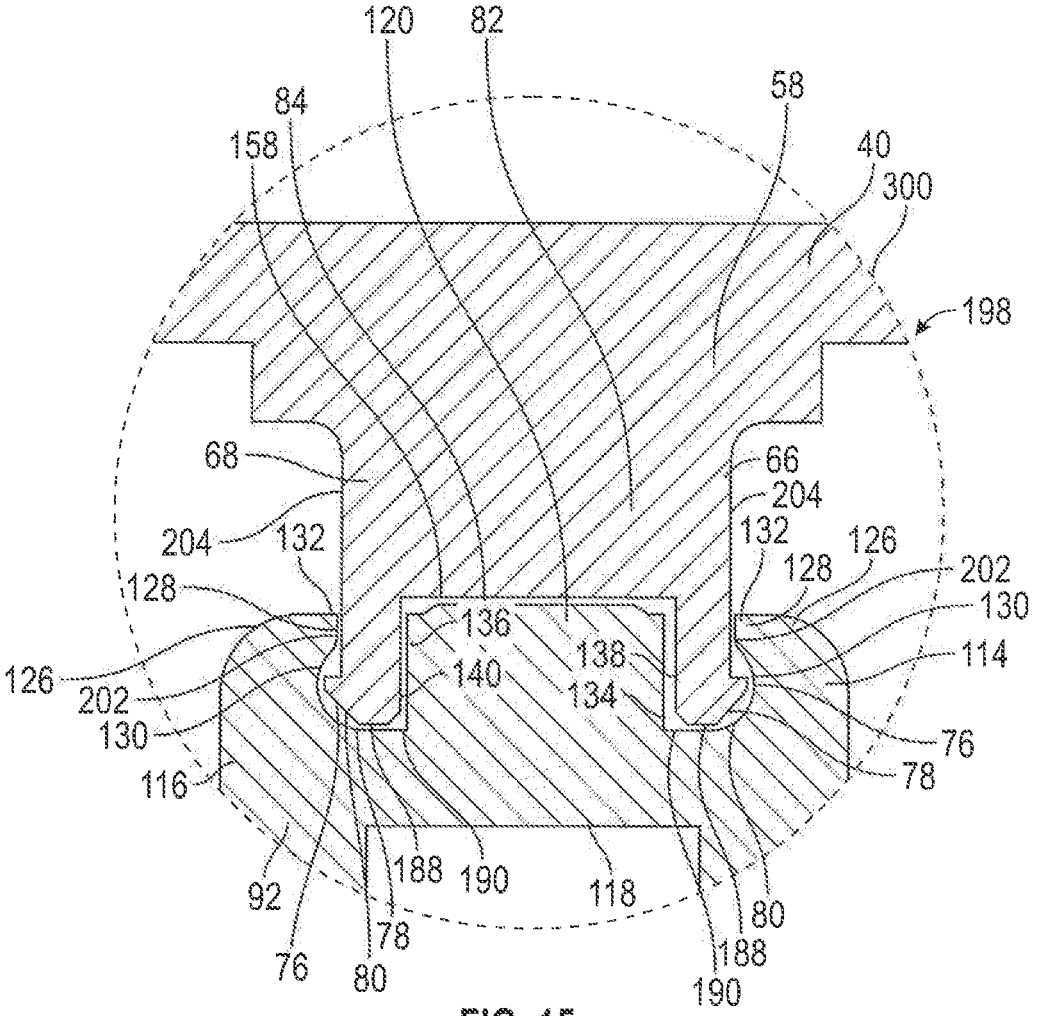
FIG. 15 is an enlarged cross-sectional view of the piston forming element and the pump driver shown in FIG. 12A in the coupled position.

Preferably, the first inner surface 138 of the first driver hook 72 engages with the first side surface 134 of the central portion 120 while the cam surface 80 of the first driver hook 72 engages with the camming surface 132 of the first piston arm 114, so that the first driver hook 72 acts as a wedge moving between the central portion 120 of the piston-forming element 92 and the first piston arm 114 to deflect the first piston arm 114 laterally outwardly, as shown in FIG. 14. The second inner surface 140 of the second driver hook 74 likewise preferably engages with the second side surface 136 of the central portion 120 while the cam surface 80 of the second driver hook 74 engages with the camming surface 132 of the second piston arm 116, so that the second driver hook 74 acts as a wedge moving between the central portion 120 of the piston forming element 92 and the second piston arm 116 to deflect the second piston arm 116 laterally outwardly. There are thus preferably four lateral surfaces on the pump driver 40 that engage with four lateral surfaces on the piston-forming element 92. This helps to locate the piston-forming element 92 in lateral alignment relative to the pump driver 40. Furthermore, the driver hooks 72, 74 and the piston hooks 126 are each extended in the back-to-front direction, which provides extensive contact in the back-to-front direction between the pump driver 40 and the piston-forming element 92. This also helps to locate the piston-forming element 92 in lateral alignment relative to the pump driver 40.

If the pump driver 40 and the piston-forming element 92 are perfectly aligned along the driver axis 70 when the pump driver 40 is moved downwardly from the uncoupled position to the coupled position, then the beveled bottom edges 200 of the first inner surface 138 and the second inner surface 140 do not engage with the first side surface 134 or the second side surface 136 of the central portion 120. If, however, the pump driver 40 is slightly misaligned with the piston-forming element 92 as the pump driver 40 moves downwardly, then the beveled bottom edge 200 of one of the inner surfaces 138, 140 may come into contact with one of the side surfaces 134, 136. The engagement of the beveled edge 200 with the side surface 134, 136 displaces the pump driver 40 laterally relative to the piston-forming element 92, so that the driver axis 70 moves towards alignment with the pump axis 112. The beveled edges 200 thus also help the pump driver 40 to be self-centering as it moves into engagement with the piston-forming element 92.

When the pump driver 40 reaches the second axial position as shown in FIG. 15, the driver tips 76 move below the piston tips 128 and the cam surfaces 80 disengage from the camming surfaces 132, allowing the piston arms 114, 116 to move laterally inwardly under the resiliency of the piston arms 114, 116 to the coupled position shown in FIG. 15. When in the coupled position, the catching shoulders 130 of the piston arms 114, 116 are positioned axially above and in opposition to the catch shoulders 78 of the driver hooks 72, 74, and the central portion 120 of the piston forming element 92 extends into the gap 86 between the first driver arm 66 and the second driver arm 68.

Optionally, when in the coupled position, an inner surface 202 of each piston tip 128 engages with an outer surface 204 of each driver arm 66, 68, and the inner surfaces 138, 140 of the driver arms 66, 68 engage with the side surfaces 134, 136 of the central portion 120, as shown in FIG. 15. There are thus four lateral surfaces of the pump driver 40 in engagement with four lateral surfaces of the piston-forming element 92 while in the coupled position, which helps to maintain the piston-forming element 92 in lateral alignment relative to the pump driver 40.

When the lever 170 is released, the pump driver 40 moves axially upwardly relative to the housing body 18 under the biasing force of the biasing springs 42. The upwards movement of the pump driver 40 causes the catch shoulders 78 to engage with the catching shoulders 130, lifting the piston-forming element 92 axially upwardly relative to the piston chamber-forming body 90. The engagement of the support plate 98 with the support flange 30 and the upper pump holding member 38 prevents the piston chamber-forming body 90 from moving axially relative to the housing body 18.

With the pump driver 40 now coupled to the piston-forming element 92, the piston pump mechanism 182 can be activated to dispense fluid from the fluid dispenser 10. To activate the pump mechanism 182, the exterior handle portion 172 of the lever 170 is again pulled downwardly, pivoting the lever 170 about the actuator axis 168 and driving the pump driver 40 axially downwardly relative to the housing body 18 and relative to the piston chamber-forming body 90, from the first axial position to the second axial position. As the pump driver 40 moves downwardly, one or more contact surfaces 184 of the pump driver 40 engages with one or more contacting surfaces 186 of the piston-forming element 92, driving the piston-forming element 92 downwardly relative to the piston chamber-forming body 90. In the embodiment shown in FIG. 15, the lower surfaces 188 of the first and second driver hooks 72, 74 engage with the upper surface 190 of the seat portion 118 of the piston-forming element 92, and the bottom surface 84 of the bridge member 82 engages with the top surface 158 of the central portion 120 of the piston-forming element 92. Upon release of the lever 170, the pump driver 40 again moves axially upwardly under the biasing force of the biasing springs 42, lifting the piston-forming element 92 axially upwardly relative to the piston chamber-forming body 90 via the engagement of the catch shoulders 78 with the catching shoulders 130.

The axial movement of the piston-forming element 92 relative to the piston chamber-forming body 90 downwardly upon activation of the lever 170 and then upwardly upon release of the lever 170 causes the piston chamber-forming body to draw the fluid from the fluid reservoir 88 and discharge an allotment of the fluid from the discharge outlet 110.

Figure 16:
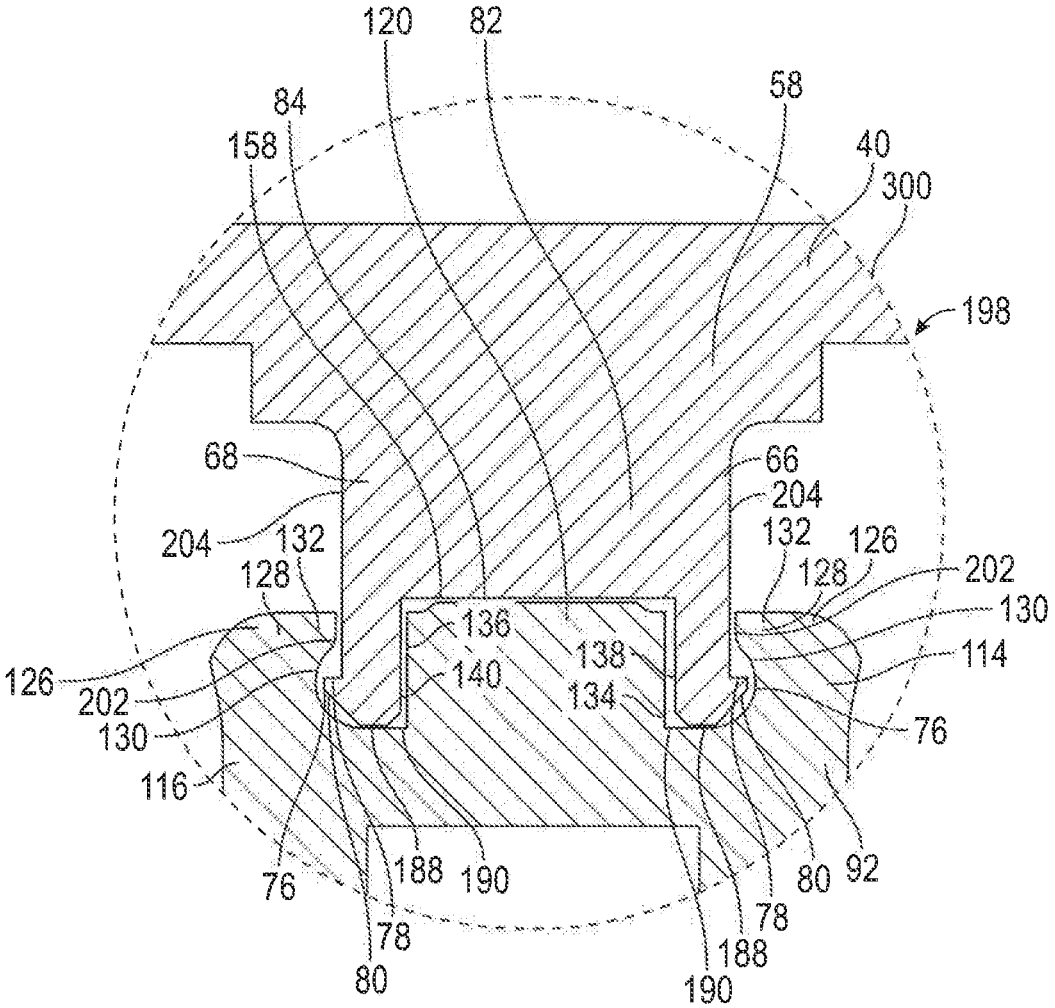
FIG. 16 is an enlarged cross-sectional view of the piston forming element and the pump driver similar to that shown in FIG. 15, with the pump driver positioned rearward on the piston forming element from the position in FIG. 15 and engaged in a slot narrowing area of the piston forming element.

The replaceable cartridge 14 can be removed and replaced when needed, for example when all of the fluid has been dispensed from the fluid reservoir 88. Because the piston arms 114, 116 and the driver arms 66, 68 are each extended in the back-to-front direction, the piston arms 114, 116 are able to slide forwardly past and out of engagement with the driver arms 66, 68. To remove the replaceable cartridge 14, the housing cover 16 is removed and the replaceable cartridge 14 is slid forwardly away from the housing 12, the forward direction being approximately 90 degrees relative to the pump axis 112 and the driver axis 70. The forwards movement of the replaceable cartridge 14 causes the driver arms 66, 68 to slide rearwardly within the piston slots 142, 144. As the driver arms 66, 68 slide rearwardly within the piston slots 142, 144, they pass from the wider hook receiving areas 154 into the narrower slot narrowing areas 156. This causes the driver arms 66, 68 to engage with the piston arms 114, 116, deflecting the piston arms 114, 116 laterally outwardly as shown in FIG. 16.

The engagement and deflection of the piston arms 114, 116 when the driver arms 66, 68 are in the slot narrowing areas 156 provides resistance against sliding the replaceable cartridge 14 forwardly relative to the housing 12 to disengage the driver hooks 72, 74 from the piston arms 114, 116, and thus helps to prevent the catch member 58 from unintentionally becoming disengaged from the piston-forming element 92. If sufficient force is applied to overcome the resistance of the piston arms 114, 116, the driver hooks 72, 74 slide out of the rear openings 148 of the piston slots 142, 144, thereby uncoupling the pump driver 40 from the piston-forming element 92. The replaceable cartridge 14 can then be fully removed from the housing 12 by sliding the support plate 98 forwardly away from the support flange 30. A replacement cartridge 14 can then be mounted to the housing 12 in the same manner as described above.

The terminal barriers 150 prevent the replaceable cartridge 14 from sliding rearwardly to disengage from the catch member 58, since the terminal barriers 150 prevent the driver hooks 72, 74 from sliding out of the piston slots 142, 144 at the front end of the piston-forming element 92.

Figure 17:
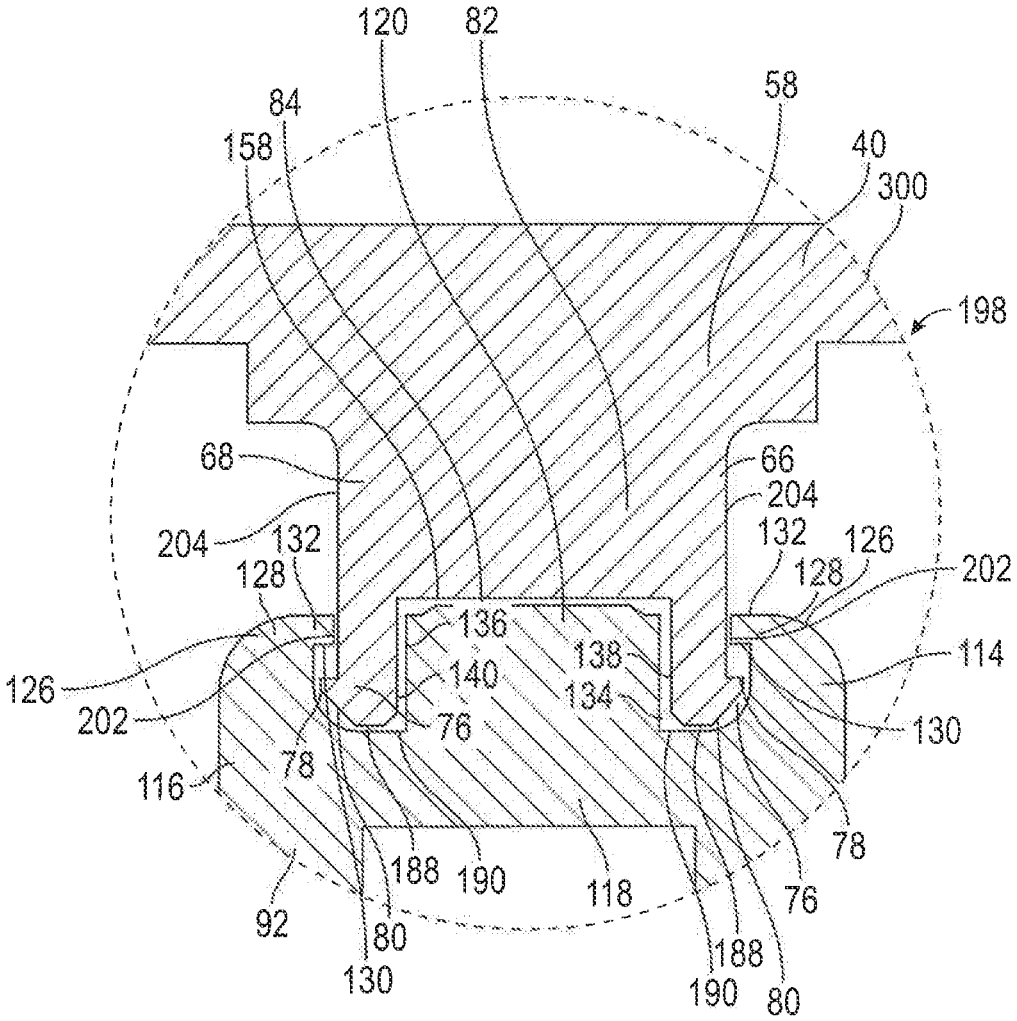
FIG. 17 is an enlarged cross-sectional view of a coupled piston forming element and pump driver of a fluid dispenser in accordance with a second embodiment of the invention.
Figure 18:
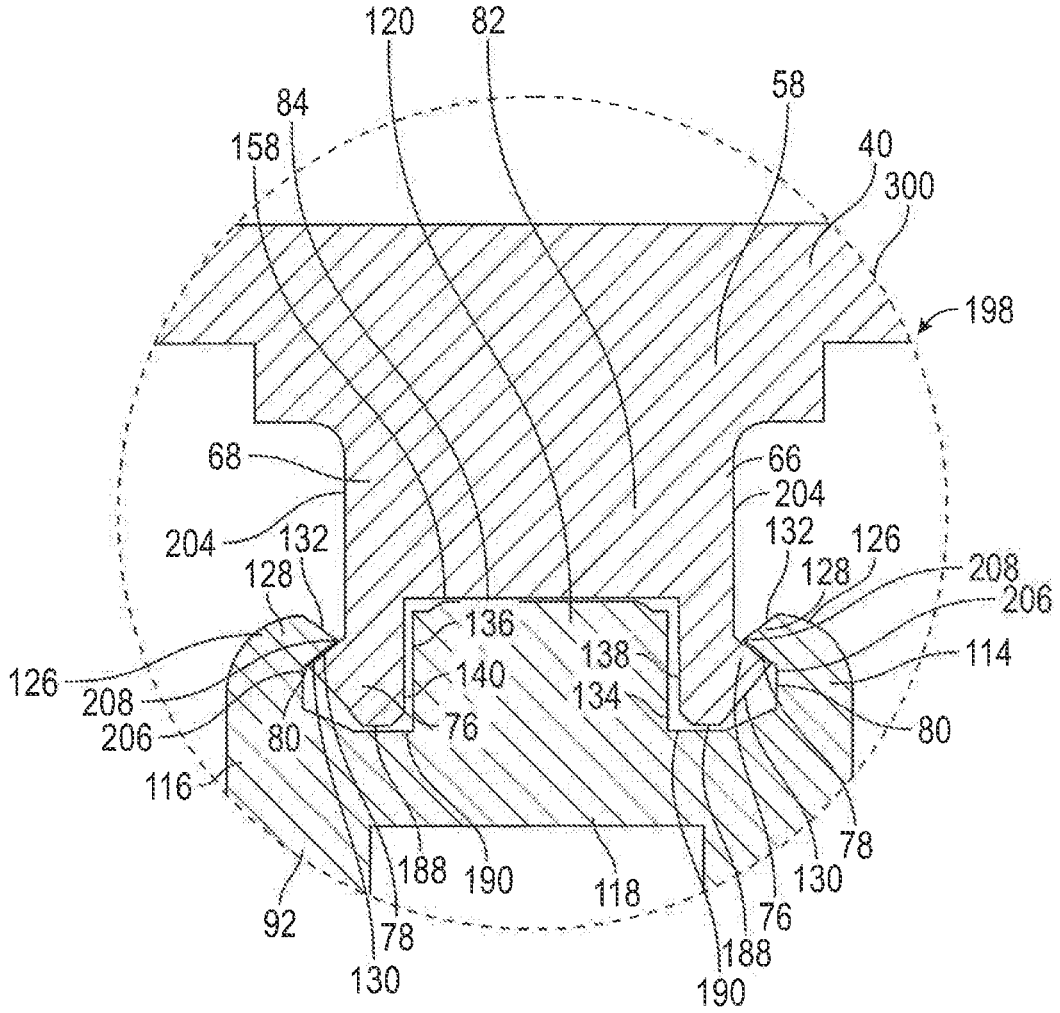
FIG. 18 is an enlarged cross-sectional view of a coupled piston forming element and pump driver of a fluid dispenser in accordance with a third embodiment of the invention.
Figure 19:
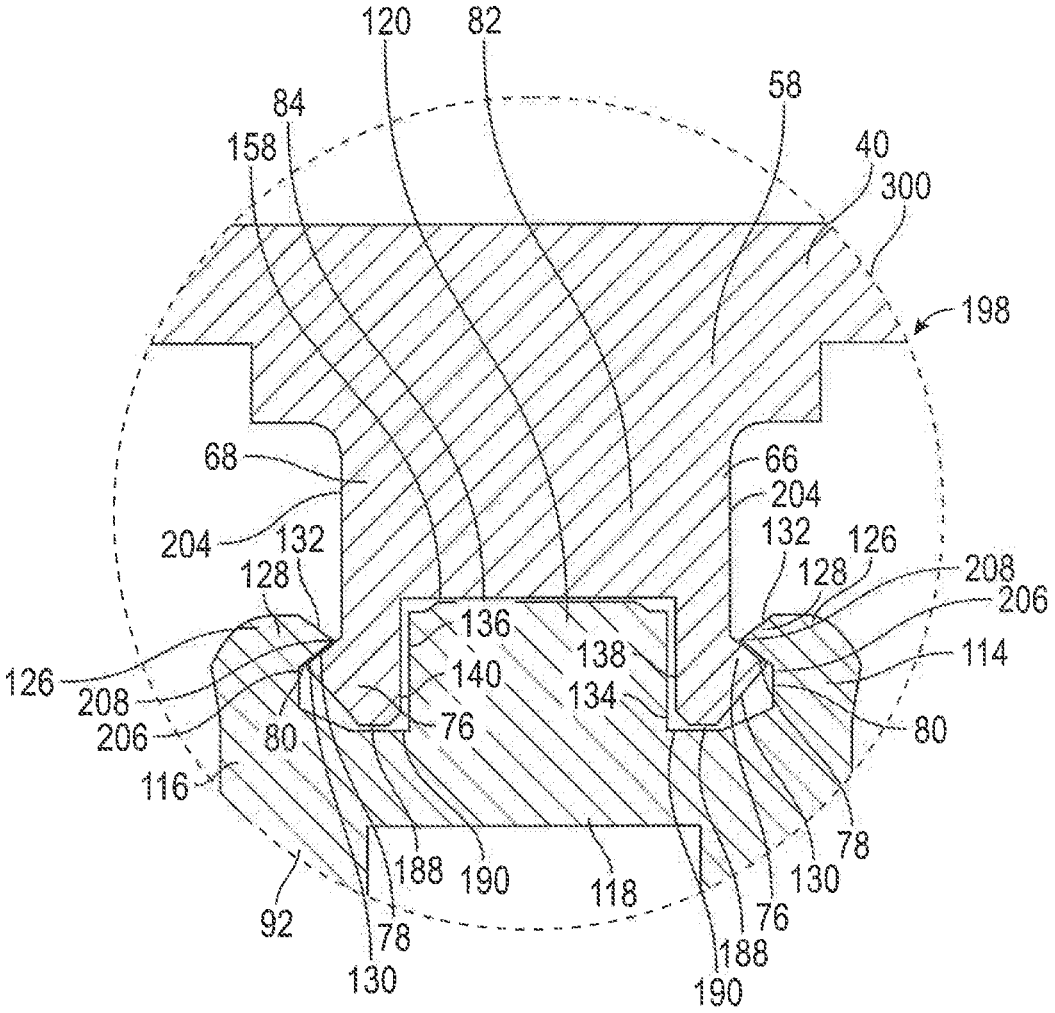
FIG. 19 is an enlarged cross-sectional view of a coupled piston forming element and pump driver of a fluid dispenser in accordance with a fourth embodiment of the invention.

In the embodiment shown in FIG. 15, the catching shoulder 130 has a curved surface and the catch shoulder 78 has a flat, horizontal surface, as seen in rear view. Optionally, the catching shoulder 130 and the catch shoulder 78 could have a different shape and configuration. For example, alternative constructions of the catching shoulder 130 and the catch shoulder 78 are shown in FIGS. 17 to 19. Like numerals are used to denote like components.

In the embodiment shown in FIG. 17, both the catching shoulder 130 and the catch shoulder 78 are horizontal and flat. This arrangement provides an extensive area of contact between the catching shoulder 130 and the catch shoulder 78 for engagement when the pump driver 40 moves upwardly to draw the piston-forming element 92 upwardly. As shown in FIG. 17, the catch shoulders 78 of the pump driver 40 are spaced axially downwardly a lost link distance from the catching shoulders 130 of the piston-forming element 92 when the lower surfaces 188 of the driver hooks 72, 74 are engaged with the upper surface 190 of the seat portion 118. This spacing between the catch shoulders 78 and the catching shoulders 130 helps to give the driver tips 76 sufficient room to slide below the piston tips 128 when moving from the uncoupled position to the coupled position. However, it also produces a lost link movement arrangement between the pump driver 40 and the piston-forming element 92, in which there is a segment of axial movement of the pump driver 40 which does not produce a corresponding axial movement of the piston-forming element 92. This occurs in each of an upward movement and a downward movement of the driver hooks 72, 74 relative the piston-forming element 92, when the driver hooks 72, 74 move axially between (a) engagement of the catch shoulders 78 of the driver hooks 72, 74 with the catching shoulders 130, and (b) engagement of the lower surfaces 188 of the driver hooks 72, 74 with the upper surface 190 of the seat portion 118, which causes the piston-forming element 92 to travel a smaller axial distance than the pump driver 40 with each activation of the dispenser 10. When the pump driver 40 moves upwardly the pump driver 40 will move the piston-forming element 92 upwardly while the catch shoulders 78 of the pump driver 40 engage the catching shoulders 130 of the piston-forming element 92. While the catch shoulders 78 of the pump driver 40 engage the catching shoulders 130 of the piston-forming element 92, the lower surfaces 188 of the driver hooks 72, 74 are spaced axially from the upper surface 190 of the seat portion 118 the lost link distance. When the pump driver 40 moves downwardly the pump driver 40 moves the piston-forming element 92 downwardly while the lower surfaces 188 of the driver hooks 72, 74 are engaged with the upper surface 190 of the seat portion 118. While the lower surfaces 188 of the driver hooks 72, 74 engage the upper surface 190 of the seat portion 118, the catch shoulders 78 of the pump driver 40 and the catching shoulders 130 of the piston-forming element 92 are spaced by the lost link distance.

Preferably, the size of the lost link is reduced as much as possible, while still allowing the driver tips 76 to move below the piston tips 128 during the coupling of the pump driver 40 to the piston-forming element 92. For example, in the embodiment shown in FIG. 15, the curved shape of the catching shoulders 130 preferably allows the catching shoulders 130 to engage with the catch shoulders 78 while the lower surfaces 188 of the driver hooks 72, 74 are engaged with the upper surface 190 of the seat portion 118, thus producing little or no lost link.

An alternative embodiment for reducing the lost link distance is shown in FIG. 18. The embodiment shown in FIG. 18 includes a larger camming surface 132 that slopes axially downwardly and laterally inwardly from the top of the piston hook 126, and both the catching shoulder 130 and the catch shoulder 78 are straight and angled diagonally, with the catching shoulder 130 directed axially downwardly and laterally inwardly and the catch shoulder 78 directed axially upwardly and laterally outwardly. In this embodiment, an edge portion 206 of the driver tip 76 where the catch shoulder 78 meets the cam surface 80 is positioned well below an edge portion 208 of the piston tip 128 where the catching shoulder 130 meets the camming surface 132 when the pump driver 40 is in the coupled position. This provides room for the piston arm 114 to deflect laterally inwardly to its unbiased inherent position after the edge portion 206 of the driver tip 76 moves below the edge portion 208 of the piston tip 128. The angle of the catching shoulder 130 and the catch shoulder 78 ensures that there is a tight engagement between the catching shoulder 130 and the catch shoulder 78, even with the edge portion 206 of the driver tip 76 positioned well below the edge portion 208 of the piston tip 128. Furthermore, as can be seen in FIG. 18, the axial distance between the lower surfaces 188 of the driver hooks 72, 74 and the catch shoulders 78 is substantially equal to the axial distance between the upper surface 190 of the seat portion 118 and the catching shoulders 130. Because these axial distances are approximately the same, the lower surfaces 188 of the driver hooks 72, 74 and the catch shoulders 78 remain in substantially uninterrupted engagement with the upper surface 190 of the seat portion 118 and the catching shoulders 130, respectively, when in the coupled position. There is thus little or no lost-link between the catching shoulder 130 and the catch shoulder 78, with the result that every axial movement of the pump driver 40 causes a corresponding axial movement of the piston-forming element 92.

The embodiment shown in FIG. 19 corresponds identically to the embodiment shown in FIG. 18, with the exception that the engagement of the catching shoulder 130 with the catch shoulder 78 causes the piston arm 114 to remain partially deflected outwardly from its unbiased inherent position when in the coupled position. The piston arm 114 thus exerts a continuous force pressing the catching shoulder 130 against the catch shoulder 78 when in the coupled position. This further helps to ensure that there is a tight engagement between the catching shoulder 130 and the catch shoulder 78, such that every axial movement of the pump driver 40 causes a corresponding axial movement of the piston-forming element 92.

Preferably, when the pump driver 40 is in the coupled position, the catching shoulders 130 remain in uninterrupted engagement with the catch shoulders 78 and the contact surface 184 remains in uninterrupted engagement with the contacting surface 186, both when the pump driver 40 is moved upwardly and when the pump driver 40 is moved downwardly relative to the piston chamber forming body 90. The uninterrupted engagement of the catching shoulders 130 with the catch shoulders 78 and the uninterrupted engagement of the contact surface 184 with the contacting surface 186 causes the piston forming element 92 to move substantially the same axial distance as the pump driver 40 when the pump driver 40 is moved axially while in the coupled position.

It will be understood that, although various features of the invention have been described with respect to one or another of the embodiments of the invention, the various features and embodiments of the invention may be combined or used in conjunction with other features and embodiments of the invention as described and illustrated herein.

The invention is not limited to the specific construction of the fluid dispenser 10 that has been described and illustrated. Rather, any suitable construction that incorporates the catch mechanism 198 as described herein could be used. The housing 12, the replaceable cartridge 14, the housing cover 16, and the lever 170 could all have a different construction from that which is shown in the preferred embodiments. The driver arms 66, 68 and the piston arms 114, 116 may have any suitable construction, and are not limited to the preferred embodiments that have been shown. In some embodiments, the driver arms 66, 68 and the piston arms 114, 116 may be configured to engage in a snap fit, with the catching shoulders 130 and the catch shoulders 78 each oriented horizontally, at 90 degrees relative to the vertical driver axis 70. In other embodiments, the catching shoulders 130 and the catch shoulders 78 are each oriented at 25 to 30 degrees from the horizontal plane, and are configured to have an interference fit that results in the driver arms 66, 68 being under constant load, which helps to maintain a tight connection between the driver arms 66, 68 and the piston arms 114, 116.

Although the preferred embodiments have been described as being manually operated, the fluid dispenser 10 could also be electronically operated.

Although the fluid dispenser 10 preferably dispenses hand cleaning fluid, such as hand soap or hand sanitizer, the dispenser 10 could be adapted to dispense other fluids as well, such as condiments, tooth paste, shaving foam, or hand lotion. The term "fluid" as used herein includes any flowable substance, including liquids, foams, emulsions, and dispersions.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

We claim:

1. A fluid dispenser comprising:

a fluid reservoir containing a fluid to be dispensed;

a housing for supporting the fluid reservoir;

a piston pump mechanism for dispensing the fluid from the fluid reservoir; and a pump driver for activating the piston pump mechanism;

the piston pump mechanism having a piston chamber forming body and a piston forming element;

the piston forming element being coaxially slideable along an axis relative to the piston chamber forming body to draw the fluid from the fluid reservoir and discharge the fluid from a discharge outlet;

the piston forming element having two resilient, deformable piston arms that extend axially upwardly from a seat portion of the piston forming element, with a first one of the piston arms positioned on a first lateral side of the piston forming element and a second one of the piston arms positioned on a second lateral side of the piston forming element;

each piston arm being secured at an anchored lower end to the seat portion and extending upwardly to an upper distal end, the upper distal end of each piston arm carrying a piston hook with a laterally inwardly extending piston tip;

each piston tip having an axially downwardly directed catching shoulder and an axially upwardly and laterally inwardly directed camming surface;

the pump driver having a downwardly extending catch member that extends from an anchored upper end to a lower distal end, the catch member having a first driver hook and a second driver hook at the lower distal end;

each of the driver hooks having a laterally outwardly extending driver tip with an axially upwardly directed catch shoulder and an axially downwardly and laterally outwardly directed cam surface;

the pump driver being movably secured to the housing for axial movement relative to the housing;

the piston pump mechanism being removably coupled to the housing, with the piston forming element positioned axially downwardly from the pump driver;

wherein the pump driver is movable from an uncoupled position to a coupled position by:

moving the pump driver axially downwards relative to the piston forming element so that the catch member engages with the piston arms, with the cam surface of the first driver hook engaging with the camming surface of the first piston arm, and the cam surface of the second driver hook engaging with the camming surface of the second piston arm, the engagement of the cam surfaces of the driver hooks with the camming surfaces of the piston arms deflecting the piston arms laterally outwardly, until the driver tips move below the piston tips, allowing the piston arms to move laterally inwardly to the coupled position under the resiliency of the piston arms;

wherein, when in the coupled position, the catching shoulders of the piston arms are positioned axially above and in opposition to the catch shoulders of the driver hooks, so that movement of the pump driver axially upwards relative to the piston chamber forming body moves the piston forming element axially upwards relative to the piston chamber forming body through engagement of the catch shoulders with the catching shoulders, and movement of the pump driver axially downwards relative to the piston chamber forming body moves the piston forming element axially downwards relative to the piston chamber forming body through engagement of a contact surface of the pump driver with a contacting surface of the piston forming element; and wherein the piston arms and the driver hooks are each extended in a back-to-front direction to allow the piston arms to slide forwardly past and out of engagement with the driver hooks, the piston pump mechanism being removable from the housing by sliding the piston pump mechanism forwardly relative to the pump driver.

2. The fluid dispenser according to claim 1, wherein each piston arm is spaced laterally from a central portion of the piston forming element that extends upwardly from the seat portion;

wherein the catch member comprises a first driver arm carrying the first driver hook and a second driver arm carrying the second driver hook, the first driver arm being spaced laterally from the second driver arm so as to define a gap therebetween; and wherein the central portion of the piston forming element extends into the gap between the first driver arm and the second driver arm when the pump driver is coupled to the piston forming element.

3. The fluid dispenser according to claim 2, wherein the central portion of the piston forming element has a first side surface that faces laterally outwardly towards the first piston arm, and a second side surface that faces laterally outwardly towards the second piston arm;

wherein the first driver hook has a first inner surface that faces laterally inwardly towards the second driver hook;

wherein the second driver hook has a second inner surface that faces laterally inwardly towards the first driver hook; and wherein, on movement of the pump driver axially downwardly from the uncoupled position to the coupled position:

the first inner surface of the first driver hook engages with the first side surface of the central portion while the cam surface of the first driver hook engages with the camming surface of the first piston arm, so that the first driver hook acts as a wedge moving between the central portion of the piston forming element and the first piston arm to deflect the first piston arm laterally outwardly; and the second inner surface of the second driver hook engages with the second side surface of the central portion while the cam surface of the second driver hook engages with the camming surface of the second piston arm, so that the second driver hook acts as a wedge moving between the central portion of the piston forming element and the second piston arm to deflect the second piston arm laterally outwardly.

4. The fluid dispenser according to claim 3, wherein the piston forming element is located in lateral alignment with the pump driver through the engagement of the first inner surface of the first driver hook with the first side surface of the central portion, the engagement of the cam surface of the first driver hook with the camming surface of the first piston arm, the engagement of the second inner surface of the second driver hook with the second side surface of the central portion, and the engagement of the cam surface of the second driver hook with the camming surface of the second piston arm.

5. The fluid dispenser according to claim 4, wherein a first piston slot is defined between the first piston arm and the first side surface of the central portion, and a second piston slot is defined between the second piston arm and the second side surface of the central portion;

wherein the first piston slot and the second piston slot are each open axially upwardly to a respective upper opening for receiving the first driver hook and the second driver hook, respectively, when the pump driver is moved axially downwardly from the uncoupled position to the coupled position;

wherein the first piston slot and the second piston slot each extend rearwardly to a respective rearward opening for releasing the first driver hook and the second driver hook, respectively, when the piston pump mechanism is slid forwardly relative to the pump driver;

wherein the piston forming element has a rear surface and a front surface;

wherein the first piston slot and the second piston slot each extend forwardly from their respective rearward openings to respective terminal barriers that are spaced rearwardly from the front surface of the piston forming element;

wherein the terminal barriers prevent the first driver hook and the second driver hook from sliding forwardly of the terminal barriers when received within the first piston slot and the second piston slot, respectively;

wherein the piston arms must be deflected laterally outwardly to disengage the driver hooks from the piston arms when the piston pump mechanism is slid forwardly relative to the pump driver;

wherein the first piston slot and the second piston slot each have a respective hook receiving area and a respective slot narrowing area, the hook receiving areas being positioned forwardly of the rearward openings, and the slot narrowing areas being positioned between the hook receiving areas and the rearward openings;

wherein the first piston slot and the second piston slot each have a narrowed slot width in the slot narrowing areas, the narrowed slot width being selected so that the driver arms engage with the piston arms and deflect the piston arms laterally outwardly when the driver arms are positioned within the slot narrowing areas; and wherein the slot narrowing areas provide resistance against sliding the piston pump mechanism forwardly relative to the pump driver to disengage the driver hooks from the piston arms.

6. The fluid dispenser according to claim 5, wherein the catching shoulders are directed axially downwardly and laterally inwardly and the catch shoulders are directed axially upwardly and laterally outwardly;

wherein an axial distance between the contact surface and the catch shoulders is substantially equal to an axial distance between the contacting surface and the catching shoulders;

wherein, when the pump driver is in the coupled position, the catching shoulders of the piston arms remain in uninterrupted engagement with the catch shoulders of the driver hooks when the pump driver is moved axially upwards relative to the piston chamber forming body, and when the pump driver is moved axially downwards relative to the piston chamber forming body;

wherein, when the pump driver is in the coupled position, the contact surface of the pump driver remains in uninterrupted engagement with the contacting surface of the piston forming element when the pump driver is moved axially upwards relative to the piston chamber forming body, and when the pump driver is moved axially downwards relative to the piston chamber forming body; and wherein the uninterrupted engagement of the catching shoulders with the catch shoulders and the uninterrupted engagement of the contact surface with the contacting surface when the pump driver is in the coupled position causes the piston forming element to move substantially the same axial distance as the pump driver when the pump driver is moved axially while in the coupled position.

7. The fluid dispenser according to claim 6, wherein the housing has an engagement mechanism that engages with the piston chamber forming body and prevents the piston chamber forming body from moving axially relative to the housing when the piston pump mechanism is coupled to the housing;

the fluid dispenser further comprising an actuator mechanism for moving the pump driver between a first axial position and a second axial position;

wherein, when the pump driver is in the uncoupled position, activation of the actuator mechanism moves the pump driver between the first axial position and the second axial position, which causes the pump driver to move from the uncoupled position to the coupled position; and when the pump driver is in the coupled position, activation of the actuator mechanism moves the pump driver between the first axial position and the second axial position, which moves the piston forming element axially relative to the piston chamber forming body, causing the piston pump mechanism to draw the fluid from the fluid reservoir and discharge the fluid from the discharge outlet;

wherein the actuator mechanism is manually activated, and the pump driver is biased to return to the first axial position upon manual release of the actuator mechanism; and wherein the catch member is substantially rigid.

8. The fluid dispenser according to claim 7, wherein the contact surface comprises a lower surface of the first driver hook and a lower surface of the second driver hook, and the contacting surface comprises an upper surface of the seat portion of the piston forming element;

wherein the piston arms are resiliently deflectable from an unbiased inherent position to a laterally outwardly deflected position, and are biased to return to the unbiased inherent position when deflected away from the unbiased inherent position towards the deflected position;

wherein, when the pump driver is in the uncoupled position and the pump driver is moved axially downwards into engagement with the piston arms, the engagement of the cam surfaces of the driver hooks with the camming surfaces of the piston arms deflects the piston arms from the unbiased inherent position towards the deflected position, and when the driver tips move below the piston tips, the piston arms move laterally inwardly to the coupled position, with the catching shoulders in engagement with the catch shoulders; and wherein the engagement of the catching shoulders with the catch shoulders while in the coupled position forces the piston arms to remain at least partially deflected laterally outwardly from the unbiased inherent position.

9. The fluid dispenser according to claim 7, wherein the contact surface comprises a bottom surface of the pump driver that extends between the first driver arm and the second driver arm, and the contacting surface comprises a top surface of the central portion of the piston forming element;

wherein the piston arms are resiliently deflectable from an unbiased inherent position to a laterally outwardly deflected position, and are biased to return to the unbiased inherent position when deflected away from the unbiased inherent position towards the deflected position; and wherein, when the pump driver is in the uncoupled position and the pump driver is moved axially downwards into engagement with the piston arms, the engagement of the cam surfaces of the driver hooks with the camming surfaces of the piston arms deflects the piston arms from the unbiased inherent position towards the deflected position, and when the driver tips move below the piston tips, the piston arms move laterally inwardly back to the unbiased inherent position.

10. The fluid dispenser according to claim 3, wherein a first piston slot is defined between the first piston arm and the first side surface of the central portion, and a second piston slot is defined between the second piston arm and the second side surface of the central portion;

wherein the first piston slot and the second piston slot are each open axially upwardly to a respective upper opening for receiving the first driver hook and the second driver hook, respectively, when the pump driver is moved axially downwardly from the uncoupled position to the coupled position; and wherein the first piston slot and the second piston slot each extend rearwardly to a respective rearward opening for releasing the first driver hook and the second driver hook, respectively, when the piston pump mechanism is slid forwardly relative to the pump driver.

11. The fluid dispenser according to claim 10, wherein the piston forming element has a rear surface and a front surface;

wherein the first piston slot and the second piston slot each extend forwardly from their respective rearward openings to respective terminal barriers that are spaced rearwardly from the front surface of the piston forming element; and wherein the terminal barriers prevent the first driver hook and the second driver hook from sliding forwardly of the terminal barriers when received within the first piston slot and the second piston slot, respectively.

12. The fluid dispenser according to claim 10, wherein the piston arms must be deflected laterally outwardly to disengage the driver hooks from the piston arms when the piston pump mechanism is slid forwardly relative to the pump driver;

wherein the first piston slot and the second piston slot each have a respective hook receiving area and a respective slot narrowing area, the hook receiving areas being positioned forwardly of the rearward openings, and the slot narrowing areas being positioned between the hook receiving areas and the rearward openings;

wherein the first piston slot and the second piston slot each have a narrowed slot width in the slot narrowing areas, the narrowed slot width being selected so that the driver arms engage with the piston arms and deflect the piston arms laterally outwardly when the driver arms are positioned within the slot narrowing areas; and wherein the slot narrowing areas provide resistance against sliding the piston pump mechanism forwardly relative to the pump driver to disengage the driver hooks from the piston arms.

13. The fluid dispenser according to claim 2, wherein the catching shoulders are directed axially downwardly and laterally inwardly and the catch shoulders are directed axially upwardly and laterally outwardly.

14. The fluid dispenser according to claim 2, wherein the contact surface comprises a lower surface of the first driver hook and a lower surface of the second driver hook, and the contacting surface comprises an upper surface of the seat portion of the piston forming element.

15. The fluid dispenser according to claim 2, wherein the contact surface comprises a bottom surface of the pump driver that extends between the first driver arm and the second driver arm, and the contacting surface comprises a top surface of the central portion of the piston forming element.

16. The fluid dispenser according to claim 1, wherein an axial distance between the contact surface and the catch shoulders is substantially equal to an axial distance between the contacting surface and the catching shoulders;

wherein, when the pump driver is in the coupled position, the catching shoulders of the piston arms remain in uninterrupted engagement with the catch shoulders of the driver hooks when the pump driver is moved axially upwards relative to the piston chamber forming body, and when the pump driver is moved axially downwards relative to the piston chamber forming body;

wherein, when the pump driver is in the coupled position, the contact surface of the pump driver remains in uninterrupted engagement with the contacting surface of the piston forming element when the pump driver is moved axially upwards relative to the piston chamber forming body, and when the pump driver is moved axially downwards relative to the piston chamber forming body; and wherein the uninterrupted engagement of the catching shoulders with the catch shoulders and the uninterrupted engagement of the contact surface with the contacting surface when the pump driver is in the coupled position causes the piston forming element to move substantially the same axial distance as the pump driver when the pump driver is moved axially while in the coupled position.

17. The fluid dispenser according to claim 1, wherein the piston arms are resiliently deflectable from an unbiased inherent position to a laterally outwardly deflected position, and are biased to return to the unbiased inherent position when deflected away from the unbiased inherent position towards the deflected position;

wherein, when the pump driver is in the uncoupled position and the pump driver is moved axially downwards into engagement with the piston arms, the engagement of the cam surfaces of the driver hooks with the camming surfaces of the piston arms deflects the piston arms from the unbiased inherent position towards the deflected position, and when the driver tips move below the piston tips, the piston arms move laterally inwardly to the coupled position, with the catching shoulders in engagement with the catch shoulders; and wherein the engagement of the catching shoulders with the catch shoulders while in the coupled position forces the piston arms to remain at least partially deflected laterally outwardly from the unbiased inherent position.

18. The fluid dispenser according to claim 1, wherein the piston arms are resiliently deflectable from an unbiased inherent position to a laterally outwardly deflected position, and are biased to return to the unbiased inherent position when deflected away from the unbiased inherent position towards the deflected position; and wherein, when the pump driver is in the uncoupled position and the pump driver is moved axially downwards into engagement with the piston arms, the engagement of the cam surfaces of the driver hooks with the camming surfaces of the piston arms deflects the piston arms from the unbiased inherent position towards the deflected position, and when the driver tips move below the piston tips, the piston arms move laterally inwardly back to the unbiased inherent position.

19. The fluid dispenser according to claim 1, wherein the housing has an engagement mechanism that engages with the piston chamber forming body and prevents the piston chamber forming body from moving axially relative to the housing when the piston pump mechanism is coupled to the housing.

20. The fluid dispenser according to claim 1, further comprising an actuator mechanism for moving the pump driver between a first axial position and a second axial position;

wherein, when the pump driver is in the uncoupled position, activation of the actuator mechanism moves the pump driver between the first axial position and the second axial position, which causes the pump driver to move from the uncoupled position to the coupled position; and when the pump driver is in the coupled position, activation of the actuator mechanism moves the pump driver between the first axial position and the second axial position, which moves the piston forming element axially relative to the piston chamber forming body, causing the piston pump mechanism to draw the fluid from the fluid reservoir and discharge the fluid from the discharge outlet;

wherein the actuator mechanism is manually activated, and the pump driver is biased to return to the first axial position upon manual release of the actuator mechanism; and wherein the catch member is substantially rigid.

* * * * *